US009499994B2

(12) United States Patent
Propst

(10) Patent No.: US 9,499,994 B2
(45) Date of Patent: Nov. 22, 2016

(54) TOOLS FOR APPLYING COATINGS AND METHOD OF USE

(71) Applicant: PROPST FAMILY LIMITED PARTNERSHIP, Phoenix, AZ (US)

(72) Inventor: John Eugene Propst, Phoenix, AZ (US)

(73) Assignee: PROPST FAMILY LIMITED PARTNERSHIP, Phoenix, AZ (US)

( * ) Notice: Subject to any disclaimer, the term of this patent is extended or adjusted under 35 U.S.C. 154(b) by 432 days.

(21) Appl. No.: 14/063,842

(22) Filed: Oct. 25, 2013

(65) Prior Publication Data

US 2014/0115804 A1 May 1, 2014

Related U.S. Application Data

(60) Provisional application No. 61/721,175, filed on Nov. 1, 2012.

(51) Int. Cl.
*E04F 21/16* (2006.01)
*E04F 21/24* (2006.01)

(52) U.S. Cl.
CPC ..... *E04F 21/162* (2013.01); *E04F 21/24* (2013.01)

(58) Field of Classification Search
CPC ..... E04F 21/162; E04F 21/24; E04F 21/16; E04F 21/06; B25F 1/00
See application file for complete search history.

(56) References Cited

U.S. PATENT DOCUMENTS 1,681,311 A 4/1928 Techmer
1,693,742 A 12/1928 Bemis
2,091,552 A 8/1937 Macauley
2,109,719 A 3/1938 Brusse
2,176,938 A 10/1939 Troy
2,902,853 A 9/1959 Lofstrom
3,044,919 A 7/1962 Stoneburner
3,145,502 A 8/1964 Rubenstein
3,284,980 A 11/1966 Dinkel (Continued)

FOREIGN PATENT DOCUMENTS

DE 2250785 A1 * 4/1974 ..... E04F 21/04
DE 2327845 A1 * 12/1974 ..... E21D 9/10
DE 9402963 U1 * 4/1994 ..... E04F 21/161

OTHER PUBLICATIONS

Dryvit Systems, Inc., What are Dryvit Outsulation Systems, http://www.dryvit.com/systems.asp?country_id=1, West Warwick, RI.

(Continued)

*Primary Examiner* — Dung V Nguyen
(74) *Attorney, Agent, or Firm* — Schmeiser, Olsen & Watts LLP

(57) ABSTRACT

Disclosed are tools for use in the building construction industry to apply coatings to surfaces. A trowel is disclosed for shaping a wet coating mixture on a surface. The trowel includes channels in the trowel head. Each channel forms a crest in the wet coating mixture in response to the trowel being passed over the wet coating mixture. Also disclosed is a tool for leveling a coating on a surface. The tool includes a screed bar, a screed bar coupling device, and a handle. The one or more than one screed bar coupling device removeably couples the screed bar to a substrate that includes the surface that the coating is to be applied to. The screed bar provides a level screed reference for the wet coating mixture. After the wet coating mixture is leveled, the screed bar is removed from the substrate.

9 Claims, 24 Drawing Sheets

(56) References Cited

U.S. PATENT DOCUMENTS

| | | | |
|---|---|---|---|
| 3,492,196 | A | 1/1970 | Moore |
| 3,662,507 | A | 5/1972 | Espeland |
| 3,835,608 | A | 9/1974 | Johnson |
| 3,982,368 | A | 9/1976 | Perrin |
| 4,049,874 | A | 9/1977 | Aoyama et al. |
| 4,113,913 | A | 9/1978 | Smiley |
| 4,186,536 | A | 2/1980 | Piazza |
| 4,191,001 | A | 3/1980 | Lheureux |
| 4,193,240 | A | 3/1980 | Odoerfer |
| 4,288,962 | A | 9/1981 | Kavanaugh |
| 4,314,431 | A | 2/1982 | Rabassa |
| 4,342,180 | A | 8/1982 | Gibson et al. |
| 4,349,398 | A | 9/1982 | Kearns et al. |
| 4,489,530 | A | 12/1984 | Chang |
| 4,525,965 | A | 7/1985 | Woelfel |
| 4,558,552 | A | 12/1985 | Reitter, II |
| 4,578,915 | A | 4/1986 | Schneller |
| 4,646,498 | A | 3/1987 | Schneller et al. |
| 4,653,243 | A | 3/1987 | Burkett |
| 4,669,240 | A | 6/1987 | Amormino |
| 4,774,794 | A | 10/1988 | Grieb |
| 4,852,316 | A | 8/1989 | Webb |
| 4,876,151 | A | 10/1989 | Eichen |
| 4,882,888 | A | 11/1989 | Moore |
| 5,127,204 | A | 7/1992 | Braun |
| 5,231,813 | A | 8/1993 | Drawdy |
| 5,246,640 | A | 9/1993 | Bryant |
| 5,248,549 | A | 9/1993 | Silva et al. |
| 5,335,472 | A | 8/1994 | Phillips |
| 5,353,560 | A | 10/1994 | Heydon |
| 5,404,685 | A | 4/1995 | Collins |
| 5,410,852 | A | 5/1995 | Edgar et al. |
| 5,473,849 | A | 12/1995 | Jones, Jr. et al. |
| 5,735,090 | A | 4/1998 | Papke |
| 5,758,461 | A | 6/1998 | McManus |
| 5,758,463 | A | 6/1998 | Mancini, Jr. |
| 5,771,649 | A | 6/1998 | Zweig |
| 5,826,388 | A | 10/1998 | Irving |
| 5,842,276 | A | 12/1998 | Asher et al. |
| 5,916,392 | A | 6/1999 | Ghanbari |
| 5,921,046 | A | 7/1999 | Hammond, Jr. |
| 5,966,885 | A | 10/1999 | Chatelain |
| 5,979,131 | A | 11/1999 | Remmele et al. |
| 6,006,480 | A | 12/1999 | Rook |
| 6,044,603 | A | 4/2000 | Bader |
| 6,112,489 | A | 9/2000 | Zweig |
| 6,119,422 | A | 9/2000 | Clear et al. |
| 6,119,432 | A | 9/2000 | Niemann |
| 6,263,628 | B1 | 7/2001 | Griffin |
| 6,314,695 | B1 | 11/2001 | Belleau |
| 6,314,704 | B1 | 11/2001 | Bryant |
| 6,355,333 | B1 | 3/2002 | Waggoner et al. |
| 6,401,413 | B1 | 6/2002 | Niemann |
| 6,434,900 | B1 | 8/2002 | Masters |
| 6,438,923 | B2 | 8/2002 | Miller |
| 6,526,714 | B1 | 3/2003 | Billings et al. |
| 6,622,452 | B2 | 9/2003 | Alvaro |
| 6,698,150 | B1 | 3/2004 | DiLorenzo |
| 6,715,249 | B2 | 4/2004 | Rusek, Jr. et al. |
| 6,745,531 | B1 | 6/2004 | Egan |
| 6,807,786 | B1 | 10/2004 | Peck |
| 6,898,908 | B2 | 5/2005 | Messenger et al. |
| 6,918,218 | B2 | 7/2005 | Greenway |
| 6,931,809 | B1 | 8/2005 | Brown et al. |
| 7,036,284 | B1 | 5/2006 | Larson |
| 7,100,336 | B2 | 9/2006 | Messenger et al. |
| 7,194,845 | B2 | 3/2007 | Belleau |
| 7,204,065 | B2 | 4/2007 | Naji |
| 7,254,925 | B2 | 8/2007 | Stefanutti et al. |
| 7,337,591 | B2 | 3/2008 | Molina |
| 7,681,368 | B1 | 3/2010 | Rubio |
| 7,709,091 | B2 | 5/2010 | Villani et al. |
| 7,882,666 | B2 | 2/2011 | Karalic |
| 7,902,092 | B2 | 3/2011 | Egan et al. |
| 7,984,594 | B1 | 7/2011 | Propst |
| 8,127,509 | B2 | 3/2012 | Propst |
| 8,458,983 | B2 | 6/2013 | Propst |
| 2002/0157336 | A1 | 10/2002 | Worrell et al. |
| 2004/0043682 | A1 | 3/2004 | Taylor et al. |
| 2005/0144901 | A1 | 7/2005 | Egan et al. |
| 2008/0200086 | A1 | 8/2008 | Porter et al. |
| 2008/0257222 | A1 | 10/2008 | Wallner |
| 2009/0011212 | A1 | 1/2009 | Dubey et al. |
| 2009/0031656 | A1 | 2/2009 | Hunt-Hansen et al. |
| 2009/0239430 | A1 | 9/2009 | Egan et al. |
| 2010/0071292 | A1 | 3/2010 | Futterman |
| 2010/0307091 | A1 | 12/2010 | Diaz, Jr. et al. |
| 2011/0036035 | A1 | 2/2011 | Dettbarn et al. |

OTHER PUBLICATIONS

Finestone Pebbletex Finishes, Product Bulletin 1017861, BASF The Chemical Company, 4 pages, May 2008.

Panacor Sistemas De Construcción, Panel 3D Panacor Technical Manual, Document was issued to representative of Propst Family Limited Partnership LLC, the applicant for patent application Costa Rica 2012-0377, on Jan. 14, 2013, 18 pages, Costa Rica.

Panacor Sistemas De Construcción, Panel-I Panacor Information Brochure, Document was issued to representative of Propst Family Limited Partnership LLC, the applicant for patent application Costa Rica 2012-0377, on Jan. 14, 2013, 9 pages, Costa Rica.

Panacor Sistemas De Construcción, Panel-I Panacor Technical Manual, Document was issued to representative of Propst Family Limited Partnership LLC, the applicant for patent application Costa Rica 2012-0377, on Jan. 14, 2013, 36 pages, Costa Rica.

Primus, Arctic-Modified Adhesive and Base Coat, DS414, 3 pages, from Dryvit Systems, Inc. 1991.

Propst, J., Building Panel System, Patent Cooperation Treaty Application Serial No. PCT/US 12/48065, filed Jul. 25, 2012, International Search Report and Written Opinion, dated Mar. 29, 2013.

Propst, J., Composite Building and Panel Systems, Patent Cooperation Treaty Application Serial No. PCT/US 11/20563, filed Jan. 7, 2011, International Search Report and Written Opinion, dated Jun. 9, 2011.

Webster's Third New International Dictionary definition of "stucco", 1 page, 1993.

Wind-Lock, Wind-Devil 2 Fastening System, http://www.wind-lock.com/cat-25-1-5/Fasteners.htm, Leesport, PA.

* cited by examiner

TOOLS FOR APPLYING COATINGS AND METHOD OF USE

CROSS REFERENCE TO RELATED APPLICATIONS

This application claims priority to U.S. provisional patent application Ser. No. 61/721,175 to John Eugene Propst entitled "Tools for Applying Coatings and Method of Use," filed Nov. 1, 2012, which is included entirely herein by reference.

BACKGROUND OF THE INVENTION

Technical Field

This invention relates to the building construction trades and specifically to tools for applying coatings to building panels or other surfaces.

State of the Art

Buildings have historically been constructed of brick, cement block, wood or steel frame and stucco and, more recently, foam blocks. The material and techniques used in constructing buildings is evolving in an effort to increase productivity reduce cost, increase energy efficiency, reduce the amount of wood usage in buildings, and to reduce material waste.

Foam insulating structural blocks have become a popular alternative to insulation, wood and stucco, and are environmentally sustainable as compared to traditional wood, cement block, and brick construction materials. Foam block systems are lightweight, can easily be molded or formed into any needed shape, result in a thermally efficient building construction, and require less skilled manpower to form into a building structure. Other benefits include a resistance to moisture, mold, fire and insect damage. The foam blocks are constructed using materials which are recyclable and renewable, provide good insulating qualities, and are often themselves made from recycled materials. Alternatively, insulating structural blocks for building construction can also be made from other environmentally friendly materials such as straw, wood fibers, paper, and glass, for example.

Insulating structural blocks are coated with stucco, cementitious coatings, or other materials that provide structural strength, protection from wind and moisture, and/or a visually appealing surface to the building panels. However, standard tools for applying stucco do not always work well when applying coatings using advanced coating mixture materials. It is often necessary to apply coatings of uniform thickness to a surface, and the surface may cover a large area. Often the coating may need to be shaped in some way while maintaining its uniform thickness. Thus there is a need for tools for applying coating mixtures to insulating structural blocks, building panel cores, or other construction surfaces when forming building panels used in constructing buildings and other structures. There is a need for tools which facilitate applying a coating of uniform thickness to a surface. There is a need for tools which can shape coatings applied to a surface. Described herein are several types of tools for applying coatings when forming building panels.

DETAILED DESCRIPTION OF EMBODIMENTS OF THE INVENTION

Figure 1:
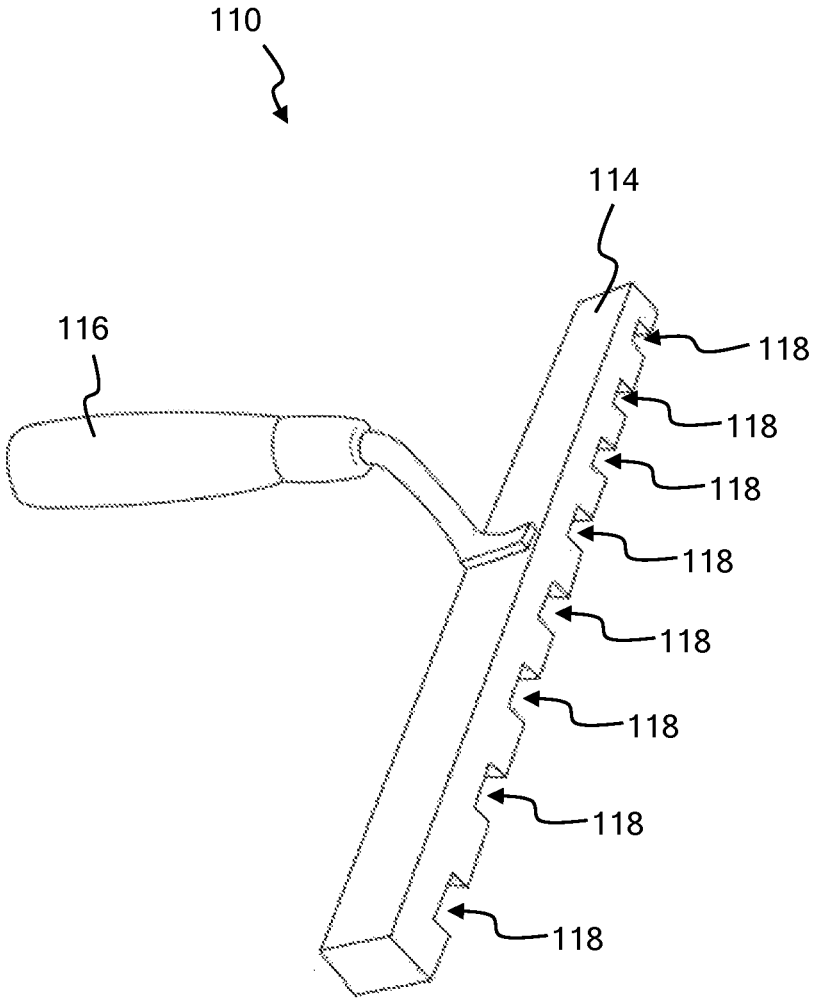
FIG. 1 is a perspective view of one embodiment of trowel 110 according the invention.

As discussed above, embodiments of the present invention relate to building construction tools and more specifically to tools for applying coatings to building panels. Disclosed are tools for applying coatings to a substrate. Coatings are applied to substrates often in the building construction industry. Cementitious and non-cementitious wet coating mixtures such as stucco, EIFS, polymer modified and polymer based coatings are applied to building panels, building panel cores, metal lath, or other structures during the course of building construction. The disclosed tools are used to apply a wet coating mixture of uniform thickness to a surface, and in some situations to form crests and valleys in a wet coating mixture on a surface.

Buildings have historically been constructed of brick, cement block, wood or steel frame and stucco and, more recently, foam blocks. The material and techniques used in constructing buildings is evolving in an effort to reduce cost, increase the energy efficiency of the resultant building, reduce the amount of wood usage in buildings, and to reduce material waste.

Foam insulating structural blocks have become a popular alternative to wood and stucco, and are environmentally sustainable as compared to traditional wood, cement block, and brick construction materials. Foam block systems are lightweight, can be molded or formed into any needed shape, result in a thermally efficient building construction, and require less skilled manpower to form into a building structure. Other benefits include, but are not limited to, a resistance to moisture, mold, fire and insect damage. The foam blocks are constructed using materials which are recyclable and renewable, provide good insulating qualities, and are often themselves made from recycled materials. Alternatively, insulating structural blocks for building construction can also be made from other environmentally friendly materials such as straw, wood fibers, paper, and glass, for example.

Insulating structural blocks are used to form building panels as detailed in U.S. Pat. Nos. 7,984,594, 8,127,509, and 8,458,983 to John E. Propst, which are incorporated entirely herein by reference.

One problem with some of the new building materials such as foam block is that the structural strength of a building element that is made with foam blocks may not be as high as when wood, brick or cement block are used to form the building element. This can be particularly important in areas where buildings are required to withstand high winds or earthquakes. There is a need for a prefabricated building panel system which minimizes construction time, uses environmentally friendly materials, and results in a building panel with high structural strength and structural integrity.

Applying coatings to a substrate is a key part of forming many different building elements, including applying stucco to a wood frame structure or applying cementitious or non-cementitious coatings to building panels. The tools described in this document can be used to apply coatings to many different surfaces, including foam blocks, stucco, integrated concrete foam (ICF) structures, exterior insulation finishing system (EIFS) surfaces, surfaces that are to be tiled or have been tiled, concrete block surfaces, wood surfaces, metal surfaces, or any other type of surface that can use a coating applied of uniform thickness. Applying coatings to building panels as described in this document increases the structural strength of the building panel and leads to a building which can withstand the elements, earthquakes, and other stresses. In some cases the coatings need to be formed and/or layered, as described herein. Described in this document are tools used to apply coatings to building panels, structures, edifices, or any other surface. Described in his document are tools used to quickly and easily apply a uniform thickness of a coating to a surface, where the surface can cover a large area. Described in this document are tools for shaping a coating mixture once the coating mixture has been applied to a surface.

Figure 2:
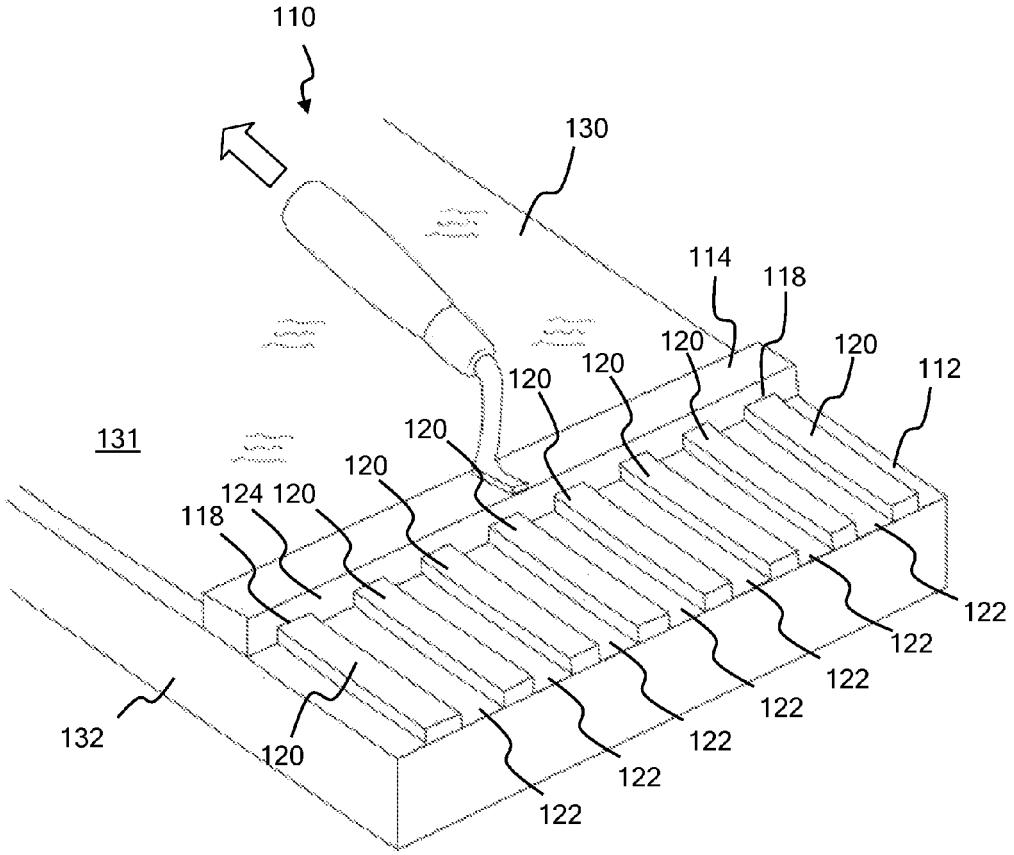
FIG. 2 is a top perspective view of trowel 110 of FIG. 1 being used to create crests 120 and valleys 122 in wet coating mixture 130.
Figure 3:
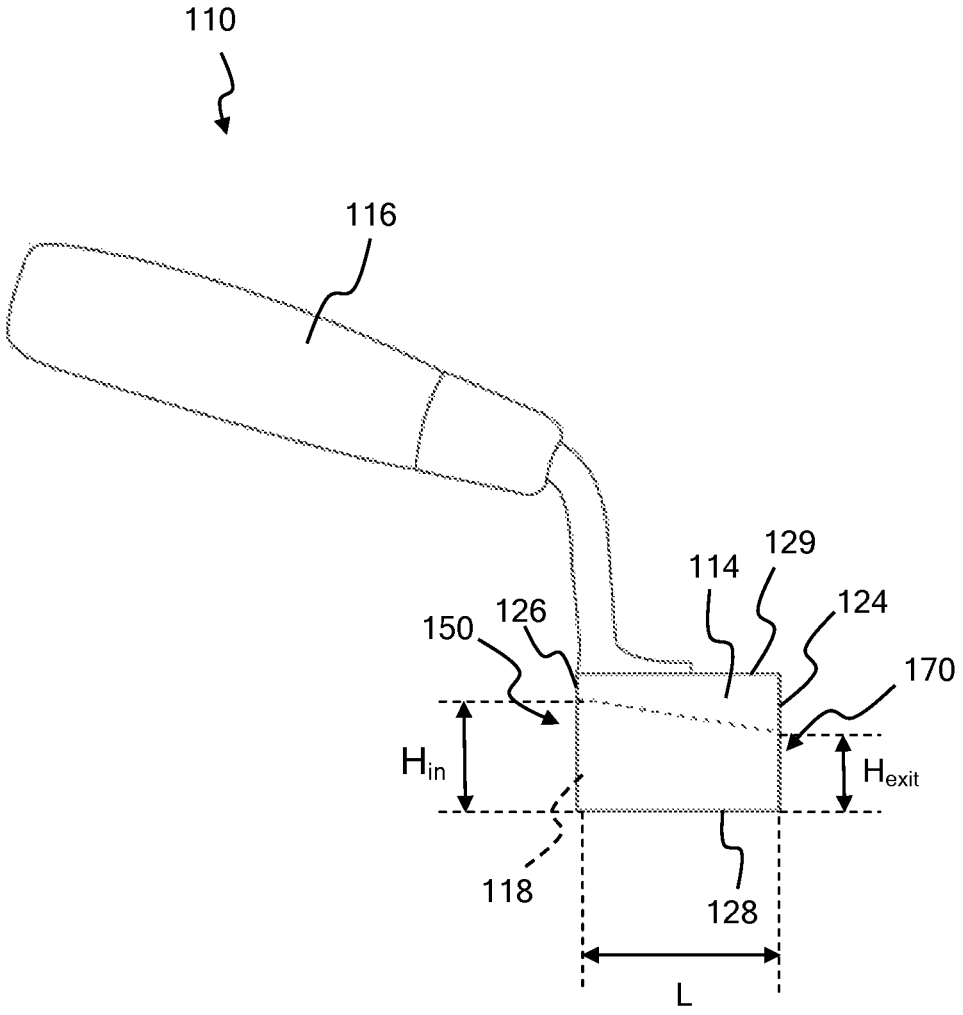
FIG. 3 is a side view of trowel 110 of FIG. 1.
Figure 4:
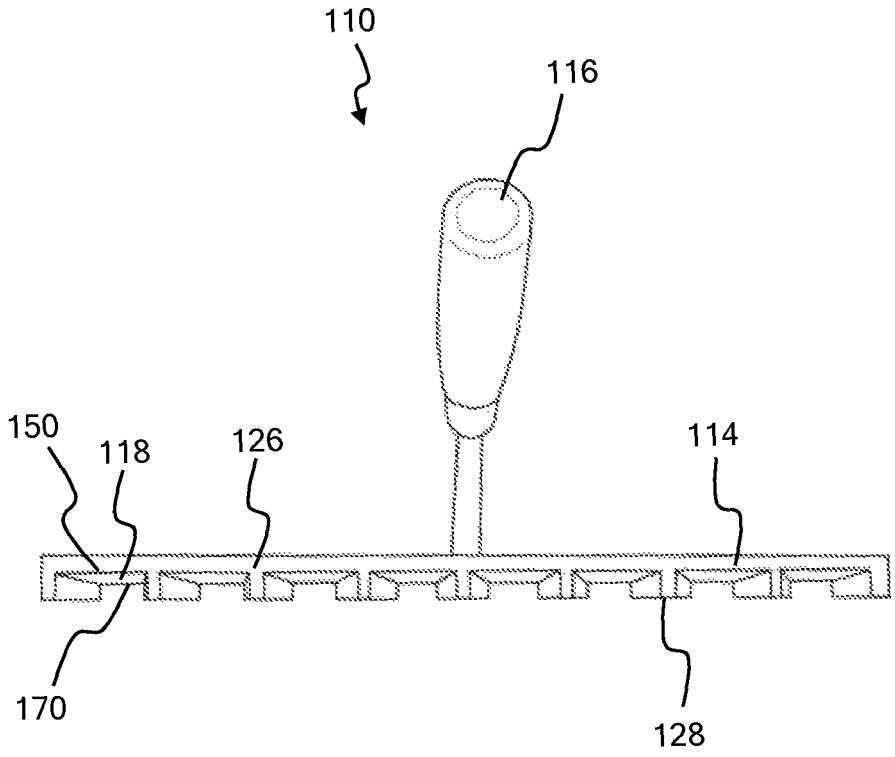
FIG. 4 is a rear perspective view of trowel 110 of FIG. 1.
Figure 5:
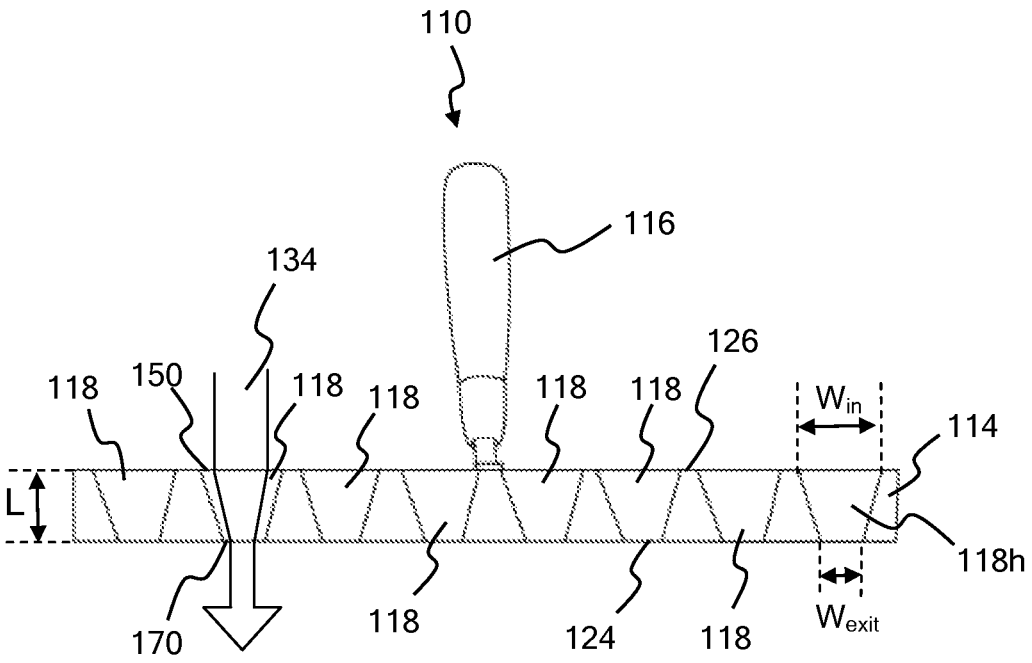
FIG. 5 is a bottom view of trowel 110 of FIG. 1.
Figure 6:
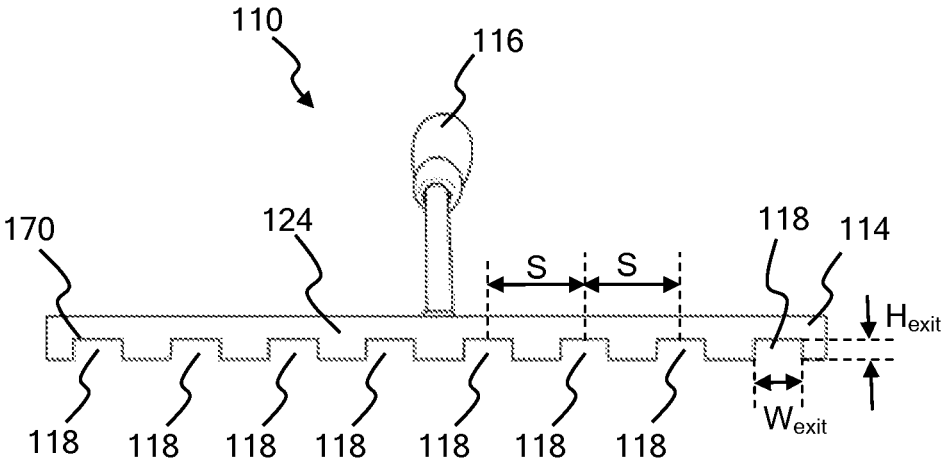
FIG. 6 is a front view of trowel 110 of FIG. 1.
Figure 7:
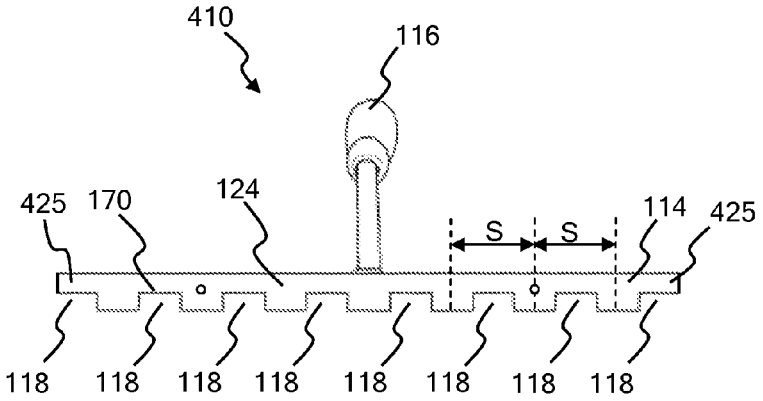
FIG. 7 is a front view of trowel 410 according to the invention.

FIG. 1 through FIG. 6 show an embodiment of trowel 110 according to the invention. FIG. 1 shows a perspective view of an embodiment of trowel 110. FIG. 2 shows trowel 110 of FIG. 1 being used to shape wet coating mixture 130. Shaping wet coating mixture 130 in this embodiment includes forming crests 120 and valleys 122 in wet coating mixture 130. FIG. 3 shows a side view of trowel 110 of FIG. 1. FIG. 4 shows a rear perspective view of trowel 110 of FIG. 1. FIG. 5 shows a bottom view of trowel 110 of FIG. 1. FIG. 6 shows a front view of trowel 110 of FIG. 1. FIG. 15 through FIG. 18 to be discussed shortly, show cross-sections of embodiments of coating mixtures shaped using trowel 110 of FIG. 1 through FIG. 6.

Trowel 110 is used to shape wet coating mixture 130 that is on a surface 112 of substrate 132 as shown in FIG. 2 Trowel 110 shapes wet coating mixture 130 when bottom surface 128 of trowel 110 is moved across top surface 131 of wet coating mixture 130. Trowel 110 according to the invention includes trowel head 114. Trowel 110 of FIG. 1 also includes handle 116. Handle 116 provides a convenient place to hold and operate trowel 110 with a hand or hands. It is to be understood that any type of handle 116 can be used with trowel 110. In some embodiments trowel 110 includes more than one handle 116. Trowel head 114 includes bottom surface 128. Bottom surface 128 comes into contact with wet coating mixture 130 when trowel 110 is moved across top surface 131 of wet coating mixture 130. Trowel head 114 in the embodiment shown in the drawings is about 12 inches wide. Trowel head 114 can have any width depending on the application and how much area is needed to be covered by trowel 110 with a single swipe of trowel 110. In some embodiments trowel 110 is about 18 inches wide. In some embodiments trowel 110 is about 3 feet wide.

Trowel head 114 includes a plurality of channels 118 in bottom surface 128. Channels 118 shape wet coating mixture 130 in response to trowel 110 moving across top surface 131 of wet coating mixture 130, as shown in FIG. 2. In this embodiment channels 118 form crests 120 and valleys 122 in wet coating mixture 130 in response to trowel 110 passing across top surface 131 of wet coating mixture 130. FIG. 2 shows wet coating mixture 130 on surface 112 of substrate 132. Trowel 110 is passed across top surface 131 of wet coating mixture 130. As trowel 110 is moved across wet coating mixture 130 on surface 112, wet coating mixture 130 passes through channels 118 in bottom surface 128. Channels 118 leave crests 120 and valleys 122 in wet coating mixture 130 in response to trowel 110 moving across top surface 131 of wet coating mixture 130. Valleys 122 are where most or all of wet coating mixture 130 has been removed from surface 112 by trowel 110. Each channel 118 forms a crest 120. Each crest 120 is a long line of wet coating mixture 130 on surface 112 in this embodiment. Each crest 120 has passed through a channel 118. Channels 118 form wet coating mixture 130 into crests 120. As wet coating mixture 130 passes through a channel 118 to form a crest 120, wet coating mixture 130 is compressed and formed. Air bubbles and excess water are removed from wet coating mixture 130, and excess wet coating mixture 130 is removed by trowel 110. Each crest 120 is formed of wet coating mixture 130 that has been shaped, compressed, has air bubbles removed, and is spaced from its neighboring crests 120. Once the wet coating mixture 130 is allowed to dry, or cure, each crest 120 is a solid crest 120 of dry coating mixture ready for further coatings or processing. Channels 118 of trowel 110 are rectangular in shape, but it is to be understood that channels 118 can be round, oval, triangular, sinusoidal or Gaussian shaped, or any other rectilinear or curvilinear shape that is desired.

Each channel 118 extends channel length L from trowel head rear surface 126 to channel head front surface 124 as seen in FIG. 3. Each channel 118 includes channel entrance opening 150 in trowel head rear surface 126, as shown in FIG. 3, and channel exit opening 170 in trowel head front surface 124. Trowel head 114 also includes trowel head top surface 129 and trowel head bottom surface 128. Trowel head bottom surface 128 is flat in between channels 118 in this embodiment. Channels 118 are open to bottom surface 128. A flat bottom surface 128 provides a surface for the operator of trowel 110 to keep flat on surface 112 while moving trowel 110 across wet coating mixture 130. Keeping bottom surface 128 flat on surface 112 ensures that crests 120 do not vary in height as trowel 110 is moved through wet coating mixture 120. Length L in this embodiment is about one inch. In some embodiments length L is greater than ¼ inch (6.35 mm). Length L should be long enough to give trowel 110 enough length for the operator to hold trowel head 114 flat on surface 112. If length L gets less than about 1/16 inch, it is too easy for trowel head 114 to be tilted so that bottom surface 128 is not flat on surface 112. If bottom surface 128 is not flat on surface 112, the height of channels 122 will not be uniform. In some embodiments length L is greater than ½ inch (12.7 mm). In some embodiments length L is greater than ¾ inch (19.05 mm). In this embodiment length L is about 1 inch (25.4 mm). A channel length L of one inch has been determined to make it easy for the operator of trowel 110 to hold bottom surface 128 flat on surface 112, keeping crests 120 of uniform height. In some embodiments bottom surface 128 and channel 118 are curved to form a trowel that can shape coatings when held at a variety of angles with respect to the surface the coating is on.

Each channel 118 extends through trowel head 114 from channel entrance opening 150 to channel exit opening 170 with length L, as shown in the figures. Channel entrance opening 150 has channel entrance opening height $H_{in}$ (FIG. 3) and channel entrance opening width $W_{in}$ (FIG. 5). The area of channel entrance opening 150 is given by $A_{in}=H_{in}\times W_{in}$, where $A_{in}$ is the area of channel entrance opening 150. Channel entrance opening height $H_{in}$ and channel entrance opening width $W_{in}$ are both larger than 3/16 inch (4.76 mm) in the embodiment of trowel 110 shown in FIG. 1 through FIG. 6. Channel entrance opening height $H_{in}$ and channel entrance opening width $W_{in}$ are often in the range of about 1/16 inch (1.6 mm) to about 2 inches (50.8 mm). This size of channel opening 150 allows sufficient wet coating material 130 into channel 118 to form a strong crest 120 with sufficient height and width to strengthen the building panel and surface 112 that crests 120 are a part of. In some embodiments channel entrance opening height $H_{in}$ and channel entrance opening width $W_{in}$ are both larger than ¼ inch (6.35 mm). In some embodiments channel entrance opening height $H_{in}$ and channel entrance opening width $W_{in}$ are both larger than 5/16 inch (7.94 mm). In some embodiments channel entrance opening height $H_{in}$ and channel entrance opening width $W_{in}$ are both larger than ⅜ inch (9.53 mm).

In trowel 110 of FIG. 1 through FIG. 6, channel entrance opening 150 is larger than channel exit opening 170 (best seen in FIG. 3, FIG. 4, and FIG. 5). Channel entrance opening 150 is larger than channel exit opening 170 in this embodiment so that channel 118 squeezes coating mixture 130 as coating mixture 130 passes through channel 118, as shown by track 134 in FIG. 5. Track 134 in FIG. 5 illustrates the path of a portion of wet coating mixture 130 as it passes through channel 118 from channel entrance opening 150 in trowel head rear surface 126 to channel exit opening 170 in trowel head front surface 124. Each channel 118 compresses a portion of wet coating mixture 130 into a crest 120. Compressing the portion of wet coating mixture 130 removes excess air, and water, and helps each crest 120 retain its desired shape and size and form a stronger cured coating. FIG. 4 illustrates channel exit openings 170 that are smaller in size than channel entrance openings 150, showing a rear perspective view down channels 118 from rear surface 126 to front surface 124.

Each channel exit opening 170 has a channel exit opening height $H_{exit}$ and a channel exit opening width $W_{exit}$ (see FIG. 3, and FIG. 6). In some embodiments channel entrance opening height $H_{in}$ is larger than channel exit opening height $H_{exit}$. In some embodiments channel entrance opening width $W_{in}$ is larger than channel exit opening width $W_{exit}$. The area of channel exit opening 170 is given by $A_{exit}=H_{exit}\times W_{exit}$. In embodiments of trowel 110 where channel entrance opening 150 is larger than channel exit opening 170, the area $A_{in}$, of channel entrance opening 150 is larger than the area $A_{exit}$ of channel exit opening 170. In the embodiment of trowel 110 shown in the figures, area $A_{in}$ is larger than area $A_{exit}$.

In the embodiment of trowel 110 shown in the figures, channel exit opening width $W_{exit}$ is equal to ⅜ inch (9.53 mm), and channel exit opening height $H_{exit}$ is equal to ⅜ inch (9.53 mm). This results in a crest 120 that is ⅜" high and ⅜" wide, which has proven to create a resultant coating structure with high strength, and optimizes the capability for each crest 120 to bond with further coatings. It is to be understood, however, that channel exit opening width $W_{exit}$ and channel exit opening height $H_{exit}$ can take many different values, different than each other or the same as each other, to form different shapes of crests 120 as desired. In some embodiments channel exit opening height $H_{exit}$ is equal to about 3/16 inch (4.76 mm). In some embodiments channel exit opening width $W_{exit}$ is equal to about 3/16 inch. Channel exit opening width $W_{exit}$ and channel exit opening height $H_{exit}$ are often in the range of 1/16 inch (1.6 mm) to about 1½ inches (38.1 mm). This range of sizes results in a crest height and width which is strong and provides a good structure for acting as a screed for a second layer.

Figure 16:
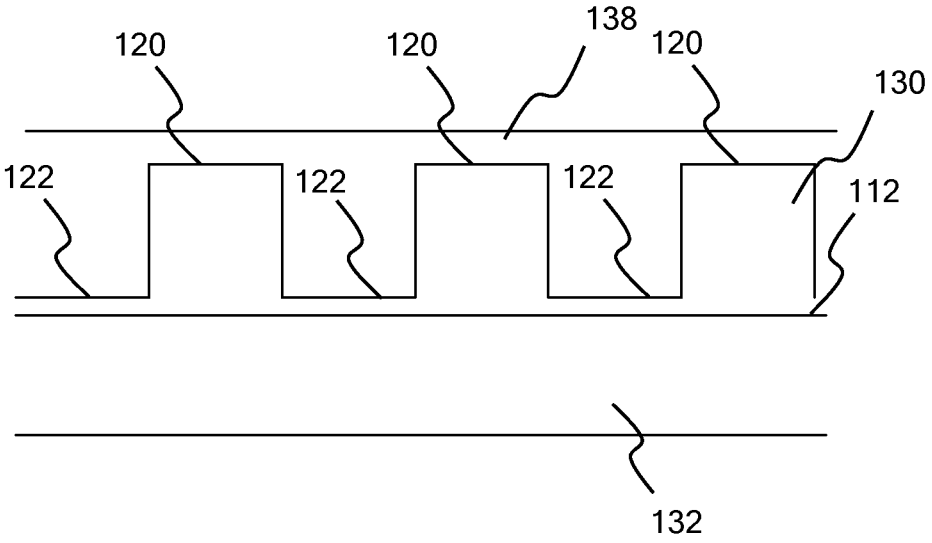
FIG. 16 is a cross-section view of wet coating mixture 130 on surface 112 after second wet coating mixture 138 has been applied.

Each channel 118 is spaced along trowel head 114 with a spacing S (FIG. 6). Spacing S is the spacing or period of channels 120. In the embodiment of trowel 110 shown in the figures, channel spacing S is equal to about ¾ inch so that crests 120 are separated by a valley 122 that has a width equal to the height and width of crests 120, but this is not meant to be limiting. In some embodiments the spacing S is greater than ¼ inch. In some embodiments the spacing S is three times $W_{exit}$. This spacing S results in a valley twice the size of the crest width. In some embodiments the spacing S is four times $W_{exit}$. In some embodiments the spacing S is ten times $W_{exit}$. Each valley 122 can be used to create a crest in a second wet coating mixture 138 (see FIG. 16) that is applied over first coating mixture 130. When spacing S equals twice the width of crests 120 as shown in FIG. 16, it has been shown that once the two coatings 130 and 138 are cured they form a layered coating with superior strength and bonding characteristics, which results in a building panel with superior strength, resistance to cracking, and resistance to puncture. The two coatings 130 and 138 also can be kept level across a wide expanse of surface 112 due to the leveling characteristic of crests 120, which are formed by trowel 110 to have a constant height $H_{exit}$. It is to be understood that spacing S can take any value, and that each spacing S in a particular embodiment of trowel 110 can vary from its neighboring spacing S in a random or controlled manner. In some embodiments spacing S varies across trowel 110 according to a predetermined function. In some embodiments spacing S is about 1 and ¼ inch (31.75 mm).

Forming crests 120 and valleys 122 in wet coating mixture 130 provides many advantages. Crests 120 and valleys 122 can be made to interlock with a second coating mixture 138 (see FIG. 16). The interlocking, or interdigitated, crests 120 and valleys 122 provide a coating with superior strength without the overall thickness of two coatings of even thickness. Another advantage is that forming crests 120 and valleys 122 "works" the wet coating mixture to remove air and excess fluid, making the resultant coating of better quality and able to resist cracks better. Another very important advantage of putting crests 120 and valleys 122 in wet coating mixture 130 is that once wet coating mixture 130 with crest 120 and valleys 122 is dry, the resultant dry coating mixture 130 acts as a built-in screed for second wet coating mixture 138. Crests 120 and valleys 122 provide a leveling coating for second coating mixture 138, allowing the applicator to keep the total thickness of the two coatings 130 and 138 even across a wide expanse of surface 112 that is being coated.

It is to be understood that surface 112 can be any surface that is to be covered with a coating. Surface 112 can be a surface of a building panel. Surface 112 can be a foam block surface, a stucco surface, an integrated concrete foam (ICF) structure surface, an exterior insulation finishing system (EIFS) surface, surfaces that are to be tiled or have been tiled, concrete block surfaces, wood surfaces, metal surfaces, or any other type of surface that needs a coating applied. Surface 112 as shown and discussed in this document is a surface of a portion of a building panel, but surface 112 can be any type of surface to be coated.

FIG. 7 through FIG. 11 shows one embodiment of trowel 410 according to the invention. Trowel 410 according to the invention is similar in structure and usage to trowel 110 of FIG. 1 through FIG. 6. One way that trowel 410 differs from trowel 110 is that trowel 410 has extensions 425 at either end because trowel 410 ends alongside a channel 118, in other words a channel 118 is open to either end of trowel body 114.

Figure 8:
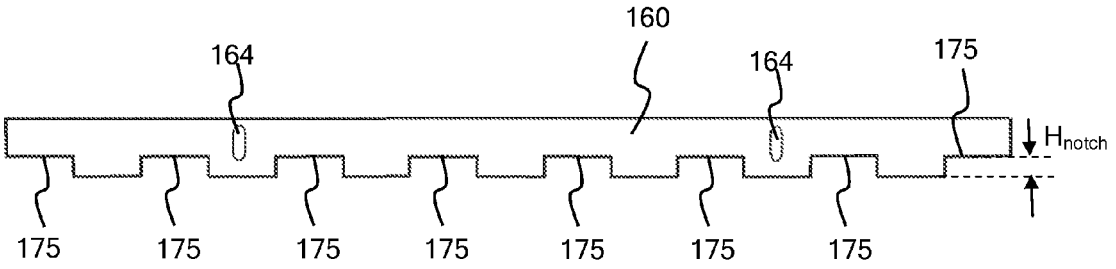
FIG. 8 is a front view of front plate 160 according to the invention.
Figure 9:
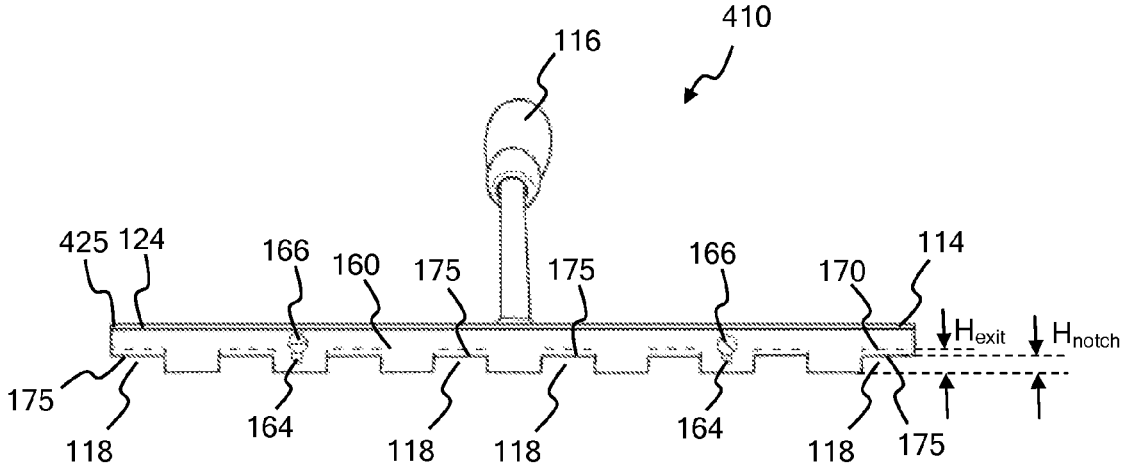
FIG. 9 is a front view of trowel 410 with removable plate 160.
Figure 10:
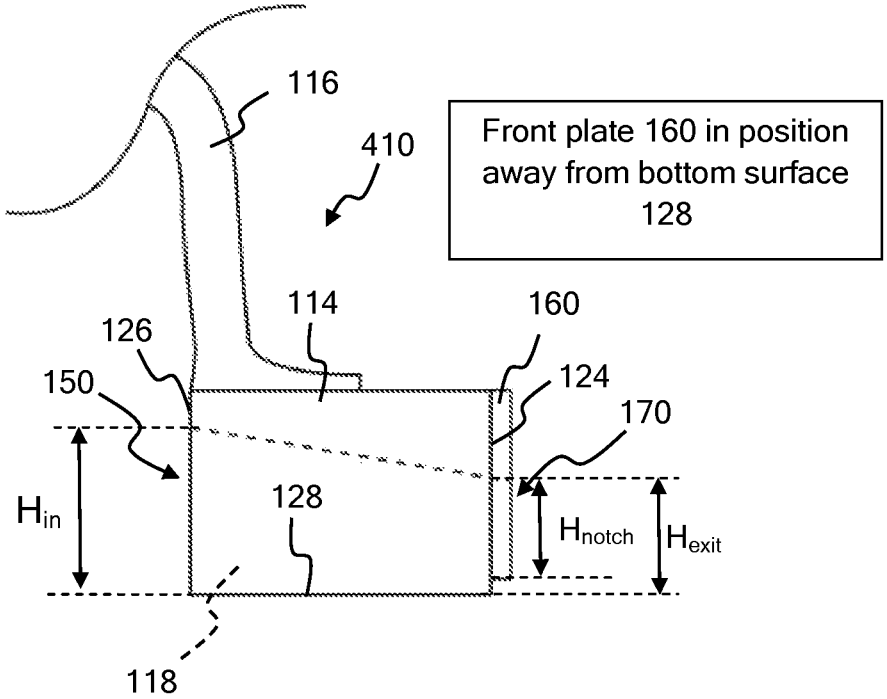
FIG. 10 is a side view of trowel 410 with removable plate 160 mounted in a position away from bottom surface 128.
Figure 11:
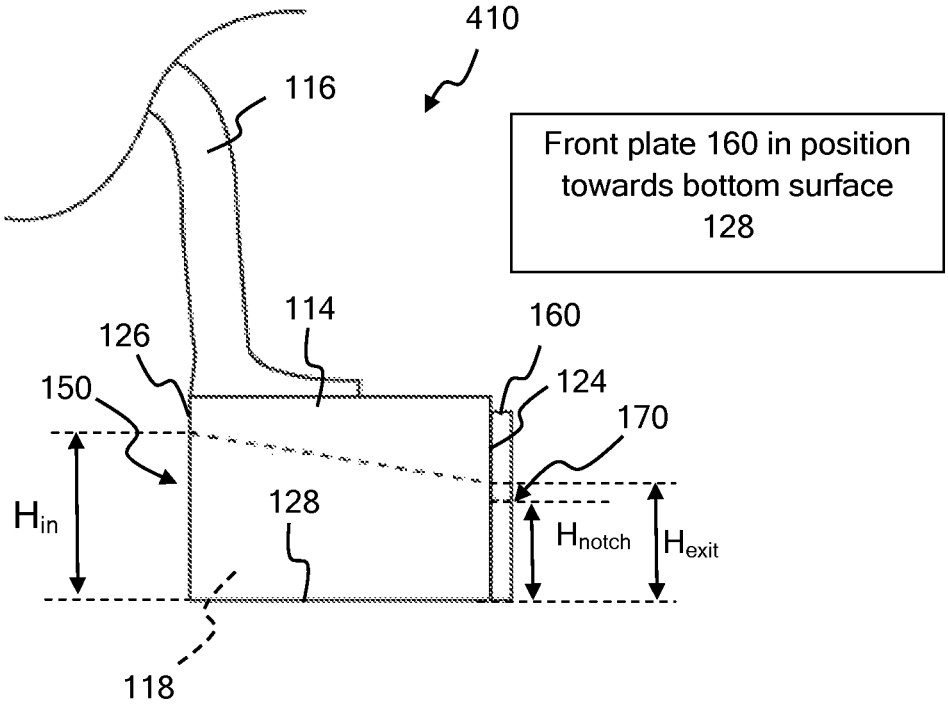
FIG. 11 is a side view of trowel 410 with removable plate 160 mounted in a position towards bottom surface 128.

Trowel 410 also includes removable front plate 160. Removable front plate 160 is shown in the figures as being used on trowel 410, but it is to be understood that removable plate 160 can be used on trowel 110 or other embodiments of a trowel according to the invention. Front plate 160 is shown in front view in FIG. 8. A front view of trowel 410 with removable front plate 160 coupled to front surface 124 is shown in FIG. 9. FIG. 10 and FIG. 11 show side views of trowel 410 with removable front plate 160 adjustably coupled to trowel front surface 124. Removable front plate 160 is adjustably coupled to front surface 124 of trowel head 114 to allow the height of crests 120 to be adjustable. With trowel 110 as shown in FIG. 1 through FIG. 6, the height and width of crest 122 is determined by channel exit height $H_{exit}$ and channel exit width $W_{exit}$. These sizes are set by the dimensions of channel exit opening 170, and are not adjustable on trowel 110. When removable front plate 160 is coupled to front surface 124, front plate 160 can be slid up and down to adjust the height of channel exit opening 170 and the height of crest 120.

Removable front plate 160 include a plurality of notches 175 that are positioned in front of channel exit openings 170 when front plate 160 is removably coupled to front surface 124, as shown in FIG. 9. Notches 175 have notch height $H_{notch}$ that is smaller than channel exit opening height $H_{exit}$.

Removable front plate 160 is mounted to front surface 124 of trowel head 114 such that front plate 160 can slide up and down away from and towards bottom surface 128, as shown in FIG. 10 and FIG. 11. Front plate 160 includes elongated holes 164 (FIG. 8). When front plate 160 is mounted to trowel head front surface 124 with screws 166 for example (FIG. 9), front plate 160 is able to be adjusted up and down because screw 166 slides in elongated hole 164. Screws 166 can be loosed to move front plate 160 up and down, and screws 166 are then tightened when front plate 160 is in the desired position towards bottom surface 128, away from bottom surface 128, or any position in between. FIG. 10 shows front plate 160 in a position away from bottom surface 128. In this position front plate 160 is slid upwards on front surface 124 until screws 166 are positioned at the bottom of elongated holes 164. When front plate 160 is in the position away from bottom surface 128 as shown in FIG. 10, notch height $H_{notch}$ does not block any portion of exit opening 170 height $H_{exit}$, as shown in FIG. 10. When front plate 160 is in the position away from bottom surface 128, $H_{notch}$ does not block a portion of channel exit opening 170. When front plate 160 is in the position away from bottom surface 128, channel exit opening height $H_{exit}$ is the height of channels 120 formed by trowel 410.

FIG. 11 shows front plate 160 in a position towards from bottom surface 128. In this position front plate 160 is slid downwards on front surface 124 until screws 166 are positioned at the top of elongated holes 164, as shown in FIG. 9. When front plate 160 is in the position towards bottom surface 128 as shown in FIG. 11, notch height $H_{notch}$ blocks a portion of exit opening 170 height $H_{exit}$, as shown in FIG. 11. When front plate 160 is in the position towards bottom surface 128, $H_{notch}$ blocks a portion of channel exit opening 170. When front plate 160 is in the position towards bottom surface 128, notch height $H_{notch}$ is the height of channels 120 formed by trowel 410. Notch 175 blocks a portion of channel exit opening 170 in response to front plate 160 being in a position towards bottom surface 128.

Removable front plate 160 allows the height of channel exit opening 170 to be adjusted, which allows the height of crests 120 to be adjusted. Thus with one tool 410 and front plate 160, a user can form channels 120 with differing heights, by setting adjustable front plate 160 such that the height of channel exit opening 170 is the desired height of crests 120. A user can form crests 120 of one height on a first surface, and crests 120 of a different height on another surface, without needing two different tools.

Figure 12:
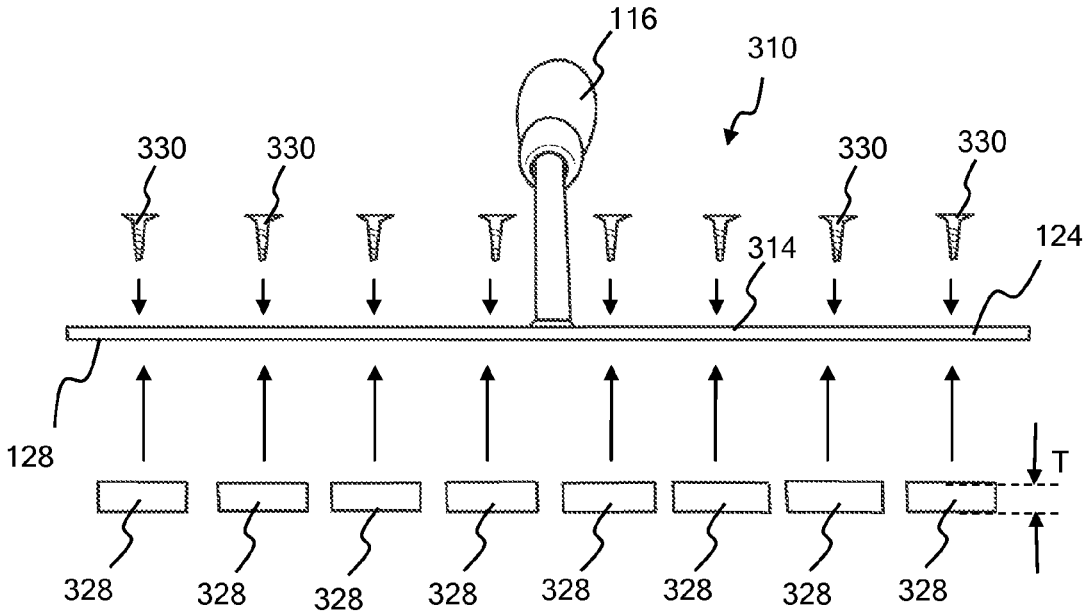
FIG. 12 is a front view of an embodiment of trowel 310 according to the invention.
Figure 13:
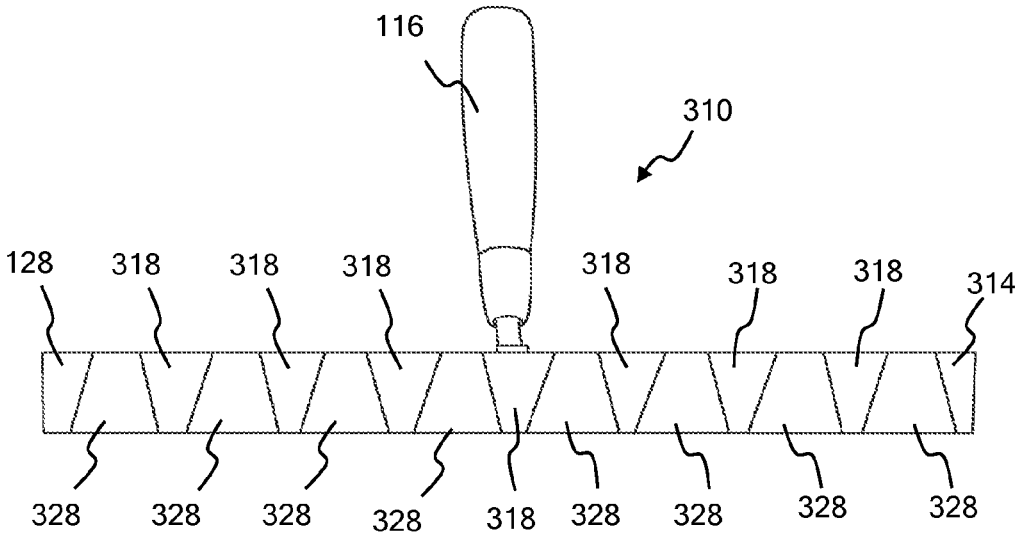
FIG. 13 is a bottom view of trowel 310 of FIG. 12.
Figure 14:
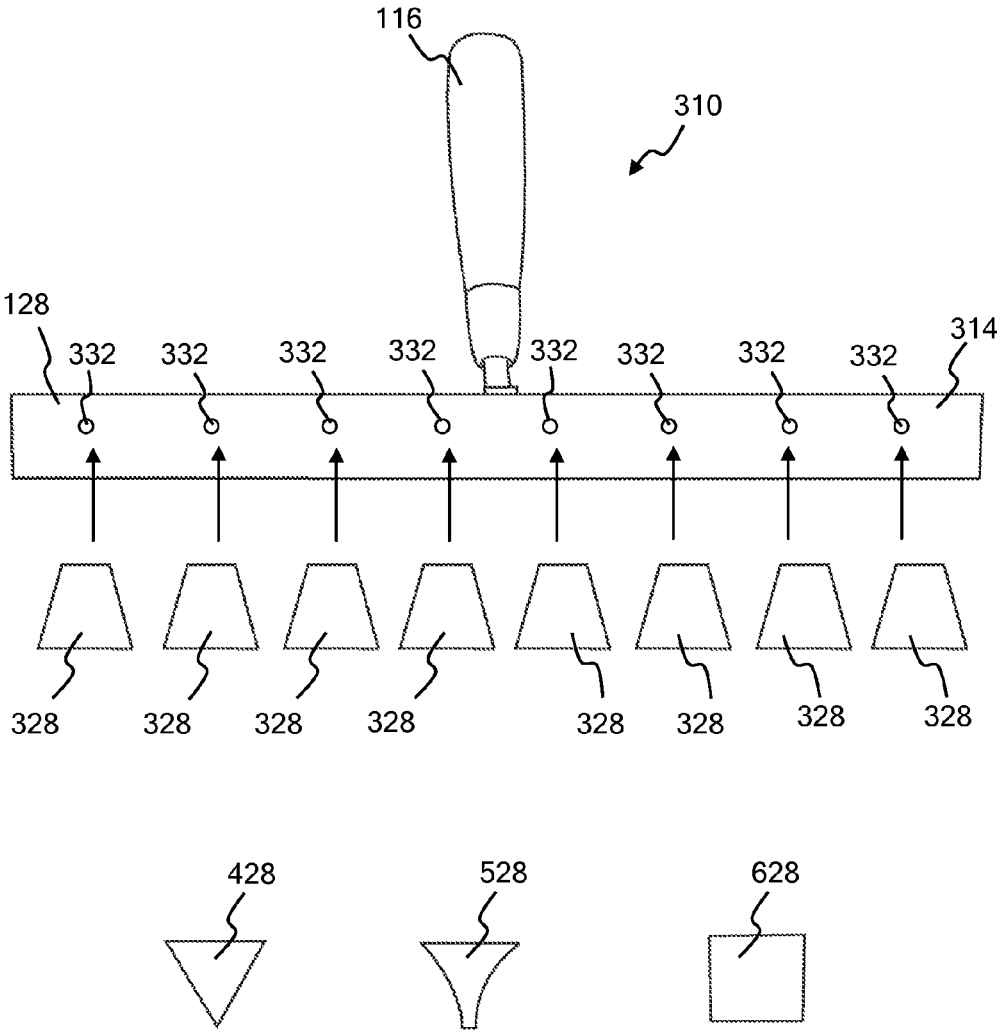
FIG. 14 is a bottom view of trowel 310 and embodiments of shaping elements according to the invention.

FIG. 12 through FIG. 14 show an embodiment of tool 310 according to the invention. FIG. 12 shows a front view of trowel 310. FIG. 13 shows a bottom view of trowel 310 of FIG. 12. FIG. 14 shows a bottom view of trowel 310 with shaping elements 328 removed from bottom surface 128. Trowel 310 of FIG. 12 through FIG. 14 includes shaping elements 328 coupled to bottom surface 128 of trowel head 114. Each shaping element 328 is removeably coupled to bottom surface 128 of trowel head 114. Shaping elements 328 provide tool 310 with the ability to further customize and tailor the size and shape of crests 120 formed with trowel 310. In this embodiment trowel 310 includes trowel head 314. Trowel head 314 does not include channels 118 in this embodiment, but this is not meant to be limiting. In some embodiments of trowel 310, trowel head 314 includes channels 118. Trowel 310 includes a plurality of shaping elements 328, which removeably couple to bottom surface 128 of trowel head 314. When shaping elements are coupled to bottom surface 128 (by screws 330, for example but not by way of limitation), shaping elements 328 are spaced on bottom surface 128 such that they form channels 318. Channels 318 are used to shape wet coating mixture 130 like channels 118 explained earlier. Wet coating mixture 130 is forced through channel 318 between shaping elements 328 when trowel 310 is moved across top surface 131 of wet coating mixture 130 as in FIG. 2.

Removable shaping elements 328 provide the capability for tool 310 to have different shaped channels 318. FIG. 14 show examples of possible bottom view shapes of shaping elements. Shaping element 328 has a rectangular shape in bottom view. Shaping element 428 has a triangle shape in bottom view. Shaping element 528 has a rectangular shape with curved sides. Shaping element 628 is square in bottom view. These examples shapes of shaping elements 328, 428, 528, and 628 can be used separately or together to create differing shapes to channels 318. The different shapes of channels 318 are used to tailor the shape of crests 120 formed in wet coating mixture 130 by trowel 310.

In some embodiments shaping elements 328, 428, 528, and/or 628 are used in conjunction with channel 118 to shape wet coating mixture 130. In some embodiments shaping elements 328, 428, 528, and/or 628 are used alone to shape wet coating mixture 130. In the embodiment shown in FIG. 12 through FIG. 14, trowel head 314 does not include channels 118. Shaping elements 328 are removably coupled to bottom surface 328. Shaping elements 328 shape wet coating mixture 130 in this embodiment. Shaping elements 328 can be shaped and spaced in any shape or spacing to create desired shapes and spacings for crests 120. In the embodiment shown in the figures, shaping elements 328 have a thickness T equal to about 3/16". In some embodiments shaping elements 328 have a thickness T equal to or greater than about 3/16". Shaping elements 328 often have a thickness in the range of 1/8 inches (3.18 mm) to 2 inches (50.8 mm). This thickness T range has been show to provide crests that are strong and provide a uniform screed height for an overlying layer. Thickness T determines the height of crests 120. Thickness T can be any value and can vary across the width of trowel bottom surface 128 in any manner to tailor the shape and height of crests 120. In some embodiments shaping elements have sides that are sloped or curved to further shape crests 120.

Figure 15:
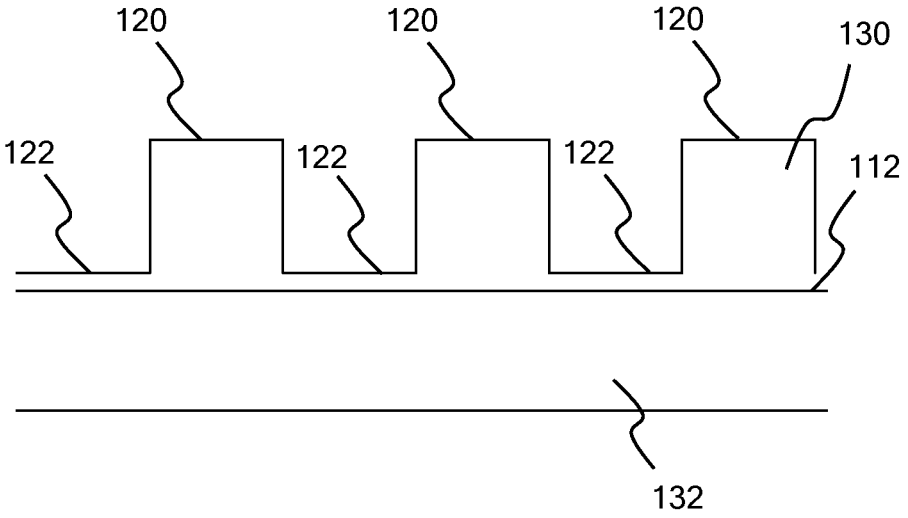
FIG. 15 is a cross-section view of wet coating mixture 130 on surface 112 after trowel 110 has been used to form crests 120 and valleys 122 in wet coating mixture 130.

FIG. 15 through FIG. 18 show embodiments of the coating structures that can be formed using trowel 110 according to the invention. FIG. 15 shows a cross-section of wet coating mixture 130 on surface 112 of substrate 132 after trowel 110 of FIG. 1 has been passed across top surface 131 of wet coating mixture 130 to create crests 120 and valleys 122 as shown in FIG. 2 and FIG. 15. It is to be understood that substrate 132 can be any type of substrate that needs to be coated, including a building, a structure, a building panel, a foam block, a coated building panel core, an uncoated building panel core, a wall, floor, or any other material that needs to be coated. In this embodiment substrate 132 is building panel core 132.

Figure 17:
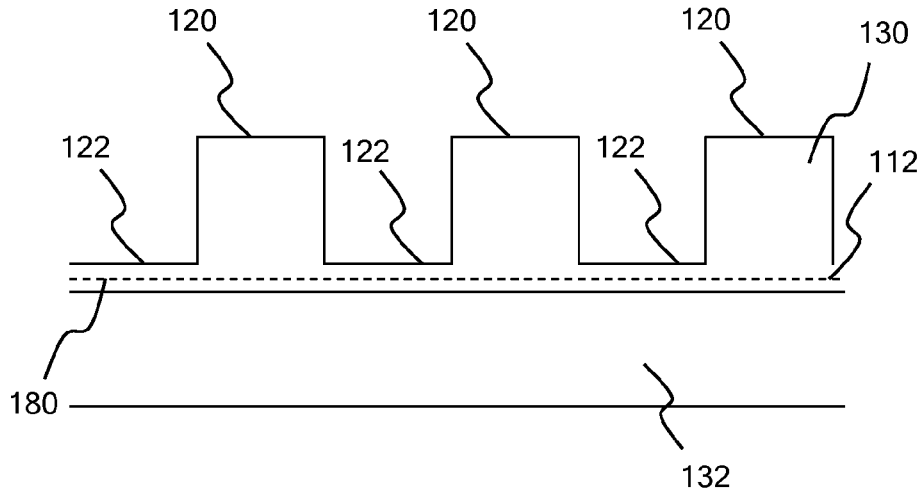
FIG. 17 shows a cross-section view of wet coating mixture 130 on surface 112, where wet coating mixture 130 includes reinforcing mesh 180.

FIG. 16 shows second wet coating mixture 138 applied over first coating mixture 130, either while coating mixture 130 is still wet or after coating mixture 130 has dried (cured). In some embodiments second wet coating mixture 138 has a reinforcing mesh, such as reinforcing mesh 180 shown in FIG. 17 and FIG. 18, embedded in second wet coating mixture 138 while second wet coating mixture 138 is still wet. In some embodiments reinforcing mesh 180 is embedded in first wet coating mixture 130 while wet coating mixture 130 is still wet, as shown in FIG. 17. In this embodiment reinforcing mesh 180 is embedded in wet coating mixture 130 before trowel 110 according to the invention is used to form crests 120 and valleys 122 in wet coating mixture 130.

Figure 18:
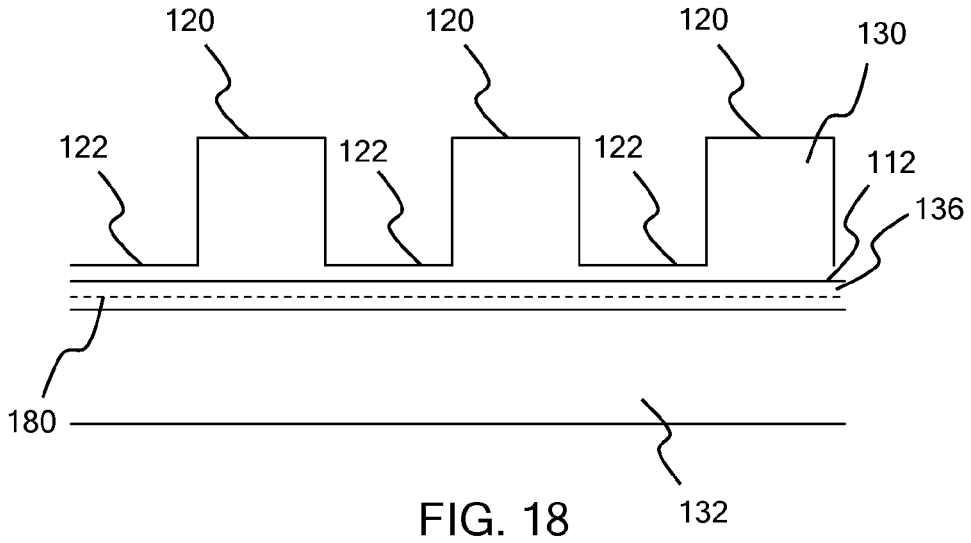
FIG. 18 is a cross-section view of wet coating mixture 130 on surface 112, where surface 112 is above scratch coat layer 136, and where scratch coat layer 136 includes reinforcing mesh 180.

FIG. 18 shows an embodiment where substrate 132 includes one or more coating layers that were applied prior to applying wet coating mixture 130. In the embodiment shown in FIG. 18, scratch coat layer 136 is applied first, and in this embodiment reinforcing mesh 180 is embedded in scratch coat layer 136. Surface 112 that receives wet coating mixture 130 is, in this embodiment, the top surface of scratch coat layer 136. It is to be understood that any number of layers can be applied and included in substrate 132 prior to applying wet coating mixture 130.

Figure 19:
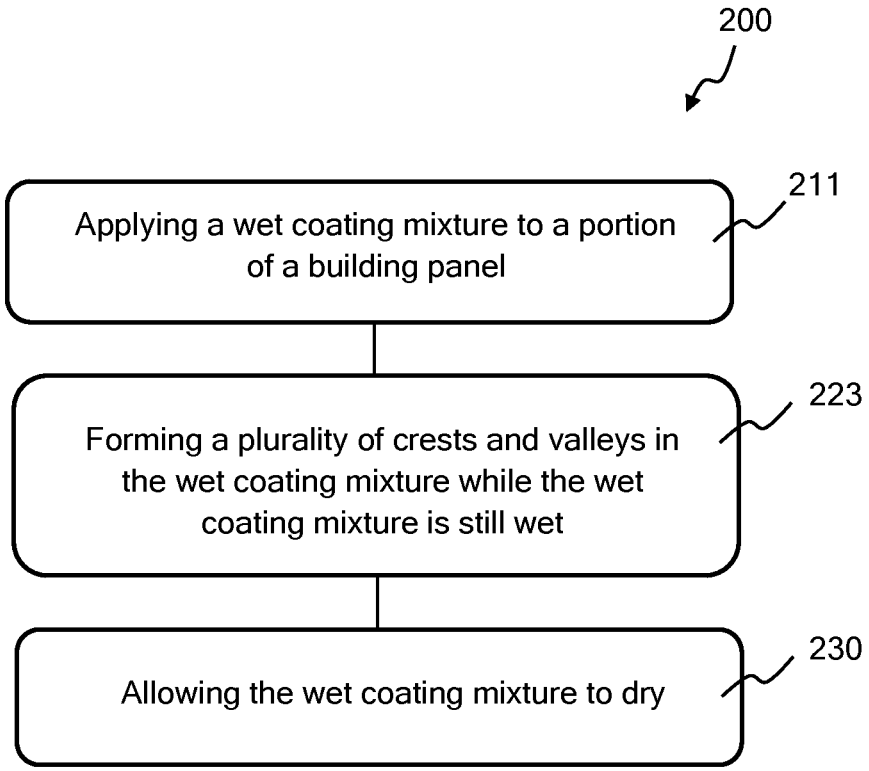
FIG. 19 illustrates method 200 of applying a coating to a building panel according to the invention.

FIG. 19 illustrates method 200 of applying a coating to a portion of a building panel. Method 200 of applying a coating to a portion of a building panel according to the invention includes step 211 of applying a wet coating mixture to a portion of a building panel. Method 200 of applying a coating to a portion of a building panel according to the invention includes step 223 of forming a plurality of crest and valleys in the wet coating mixture while the wet coating mixture is still wet. Method 200 of applying a coating to a portion of a building panel according to the invention includes step 230 of allowing the wet coating mixture to dry.

Method 200 can include many other steps. In some embodiments method 200 includes the step of applying a scratch coat layer to a portion of the building panel before the wet coating mixture is applied. In some embodiments the step of applying a scratch coat layer includes the step of embedding a reinforcing mesh in the scratch coat layer while the scratch coat layer is still wet. In some embodiments method 200 includes the step of embedding a reinforcing mesh in the wet coating mixture while the wet coating mixture is still wet. In some embodiments the wet coating mixture is a first wet coating mixture, and method 200 includes the step of applying a second wet coating mixture over a portion of the first wet coating mixture. In some embodiments the step of applying a second wet coating mixture includes the step of embedding a reinforcing mesh in the second wet coating mixture while the second wet coating mixture is still wet.

Figure 20:
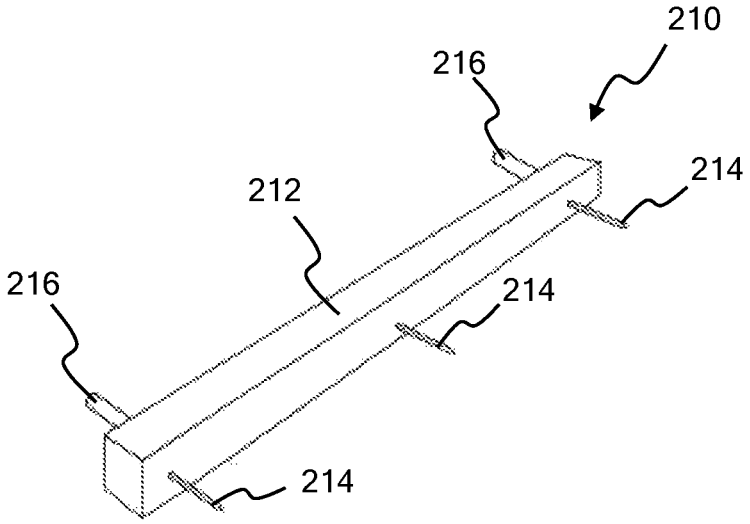
FIG. 20 shows an embodiment of tool 210 according to the invention
Figure 21:
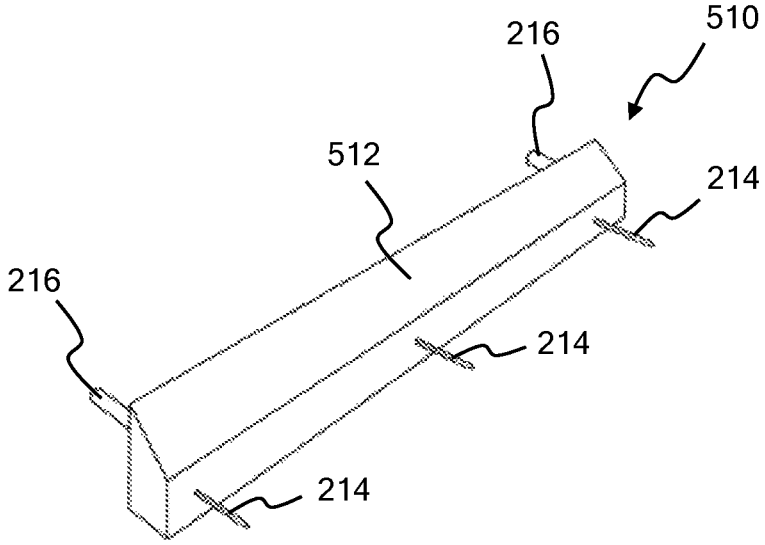
FIG. 21 shows an embodiment of tool 510 according to the invention.

FIG. 20 through FIG. 33 show embodiments and use of tool 210 and 510 according to the invention. Tool 210 and 510 are used to form a level coating mixture layer on a surface of a building, a structure, a building panel, or any other surface that needs to be coated during the construction of an edifice. FIG. 20 shows a perspective view of an embodiment of tool 210 according to the invention. FIG. 21 shows a perspective view of an embodiment of tool 510 according to the invention. FIG. 22 through FIG. 25 show how tool 210 of FIG. 20 is used in applying a level wet coating mixture on a surface. FIG. 26 through FIG. 33 shows how tool 510 of FIG. 21 is used in applying a level wet coating mixture on a surface.

Tool 210 of FIG. 20 is used to level a wet coating mixture that is applied to the surface of a substrate. Wet coating mixtures are leveled for numerous reasons, including so that the wet coating mixture can be allowed to dry in a level state, or so that the coating mixture can be further shaped, such as forming crests 120 and valleys 122 as described above using tool 110 according to the invention.

Tool 210 includes screed bar 212, one or more than one screed bar coupling device 214, and one or more than one screed bar handle 216 as shown in FIG. 20. Each of the one or more than one screed bar coupling devices 214 is coupled to screed bar 212. Each of the one or more than one screed bar handles 216 is coupled to screed bar 212.

Handle 216 is used to in the normal sense of the word handle—a device that can be grabbed with the hands to allow a user to carry, manipulate, and use tool 210. Handles 216 as shown in the drawings are cylinders coupled to screed bar 212, but any type, size, or shape of handle can be used as handle 216. In this embodiment handle 216 is mounted on screed bar 212 on a side opposite the side that includes screed bar coupling devices 214. This makes for easy access to handles 216 when tool 210 is being coupled and uncoupled to a surface.

Screed bar coupling devices 214 are used to removeably couple screed bar 212 to substrate 132. In the embodiments shown in the figures, screed bar coupling devices 214 are thin metal spikes that temporarily hold screed bar 212 to substrate 132 while wet coating mixture 130 is applied to surface 112. Once wet coating mixture 130 is applied to surface 112 and leveled, screed bar 212 is removed from substrate 132. Thus screed bar coupling devices 214 are not meant to hold screed bar 212 to substrate 132 permanently.

Figure 23:
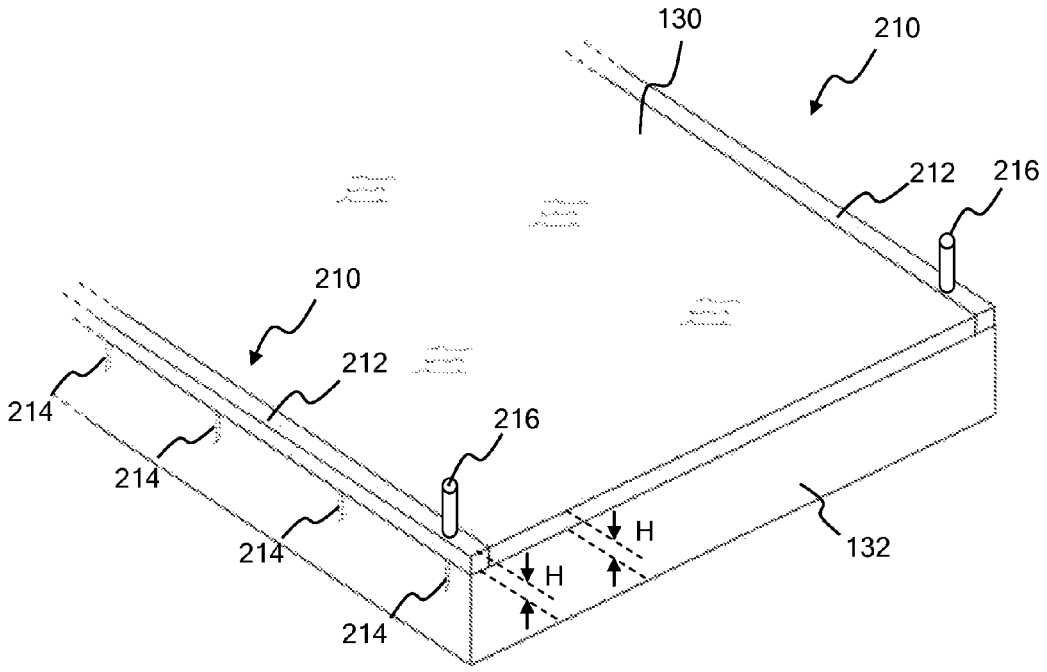
FIG. 23 is a perspective view of a second step of using tool 210 of FIG. 20 to apply a coating to a surface 112, where wet coating mixture 130 has been applied between screed bars 212 and leveled off.
Figure 24:
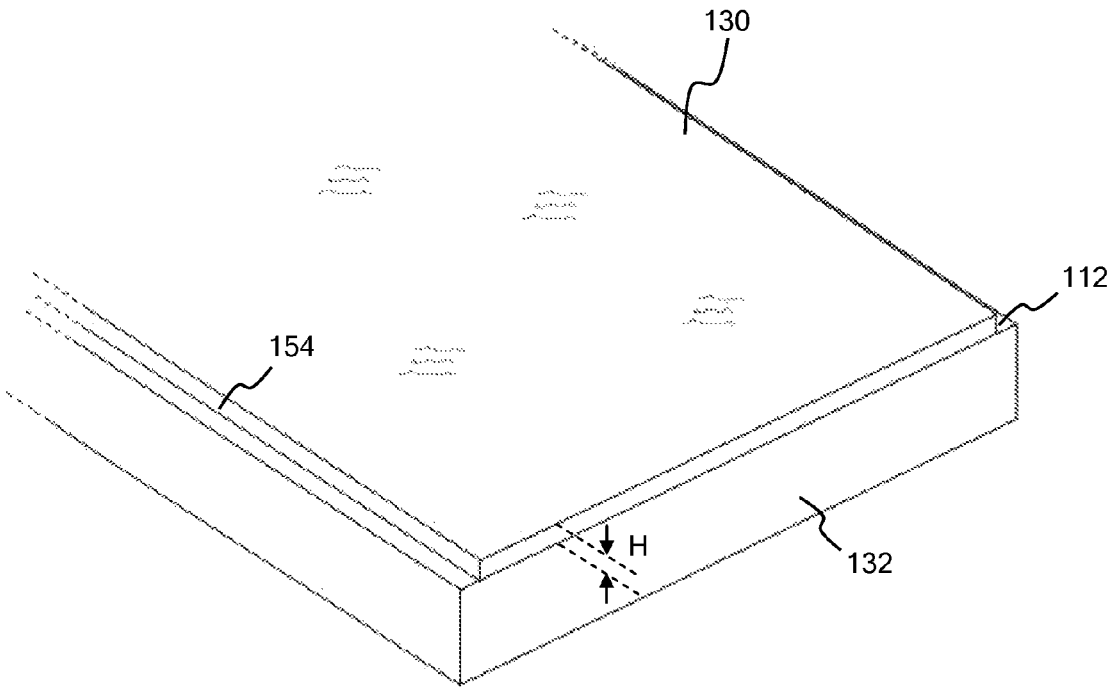
FIG. 24 shows a perspective view of a third step of using tool 210 of FIG. 20 to apply a coating to a surface 112, where both tools 210 have been removed, leaving level wet coating mixture 130 on surface 112.

Screed bar 212 can have different shapes depending on the shape of the edge needed on wet coating mixture 130, as described below. In the embodiment shown in FIG. 20 and FIG. 22 through FIG. 25, screed bar 212 has a rectangular-shaped cross-section so that edge 154 on wet coating mixture 130 is perpendicular to surface 112, as shown in FIG. 24. Tool 210 as shown in FIG. 20 includes screed bar 212 that has a rectangular cross section with height H, as shown in FIG. 23. Height H is chosen to be the desired thickness of wet coating mixture 130 on surface 112, as shown in FIG. 23 and FIG. 24.

Figure 22:
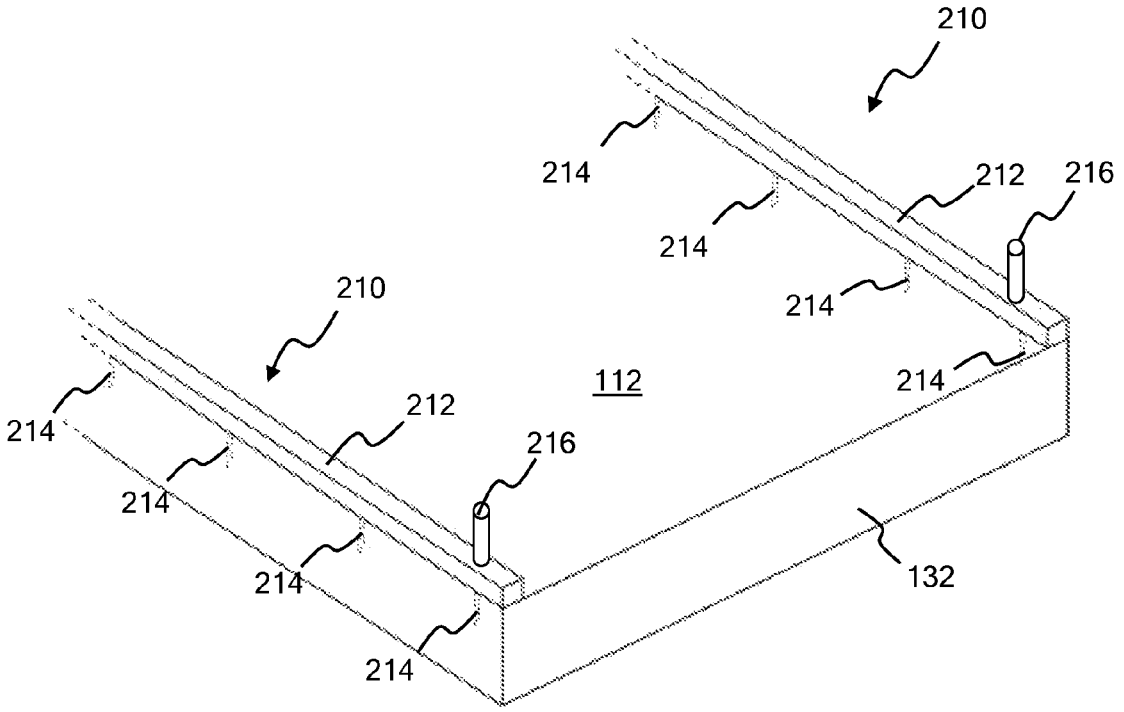
FIG. 22 shows a perspective view of tool 210 of FIG. 20 being used to apply a coating to a surface 112.

Tool 210 of FIG. 20 is used by coupling screed bar 212 to surface 112 of substrate 132 using screed bar coupling devices 214, as shown in FIG. 22. In this embodiment screed bar coupling devices 214 are stuck into substrate 132. Screed bars 212 are temporarily coupled to substrate 132 so that they outline the area of surface 112 that is to be covered with wet coating mixture 130. Once screed bars 212 are temporarily attached to surface 112 using screed bar coupling devices 214, wet coating mixture 130 is applied to surface 112 as desired. A screed is then placed on top of screed bars 212 and moved across screed bars 212 to remove excess wet coating mixture 130 and level the surface of wet coating mixture 130. The surface of wet coating mixture 130 is leveled so that the depth of wet coating mixture 130 is height H, the height of screed bar 212, as shown in FIG. 23. This leveling process is similar to that used to level cement with a screed. The result is a layer of wet coating mixture 130 between screed bars 212, where the depth of wet coating mixture 130 is height H, the height of screed bar 212. Screed bar handles 216 are then used to remove screed bars 212, leaving wet coating mixture 130 on surface 112 with a thickness of height H, as shown in FIG. 24. Wet coating mixture 130 can be left alone to cure with thickness H, or wet coating mixture 130 can be further processed or shaped. In some embodiments wet coating mixture 130 is shaped with trowel 110, 310, or 410 as explained earlier and shown in FIG. 2. In some embodiments wet coating mixture 130 is otherwise processed or shaped.

Figure 25:
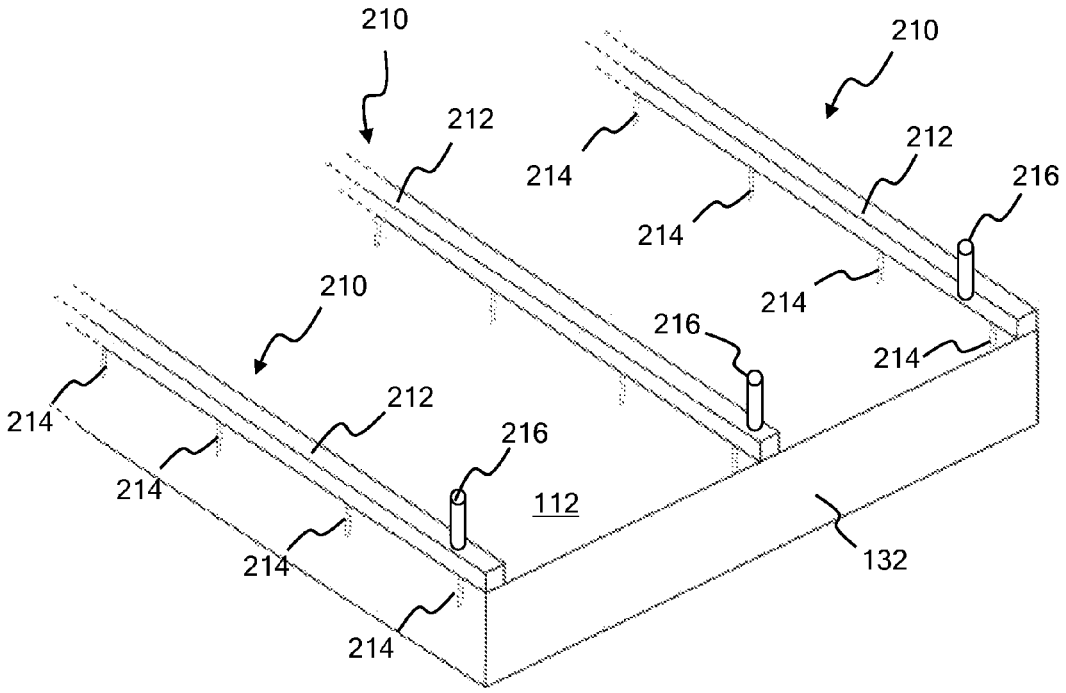
FIG. 25 shows three tools 210 being used on surface 112, illustrating that any number of tools 210 can be used to apply wet coating mixture 130 to surface 112.

It is to be understood that tool 210 can be used on any size or shape of substrate 132, with any desired placement and amount of tools 210 used, and that the embodiments shown and described are examples only. FIG. 25 shows an example where three tools 210 are placed on surface 112 of substrate 132. The number and placement of multiple tools 210 can depend on the size and shape of the area to be covered with wet coating mixture 130, and the size of the screed bar that will be laid across the multiple tools 210 to level wet coating mixture 130.

Figure 27:
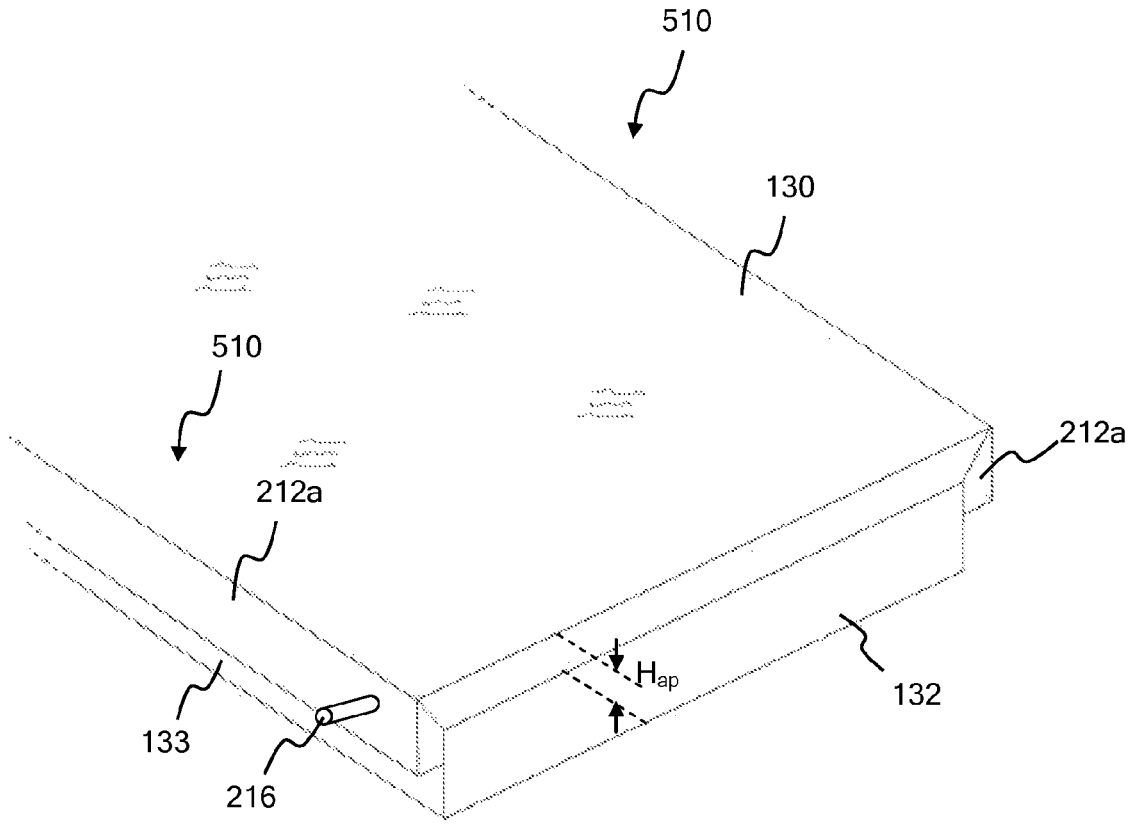
FIG. 27 shows a perspective view of a second step of using tool 510 of FIG. 21 to apply a coating to a surface 112, where wet coating mixture 130 has been applied between screed bars 512 and leveled off, using tools 510 to control the thickness of wet coating mixture 130.
Figure 28:
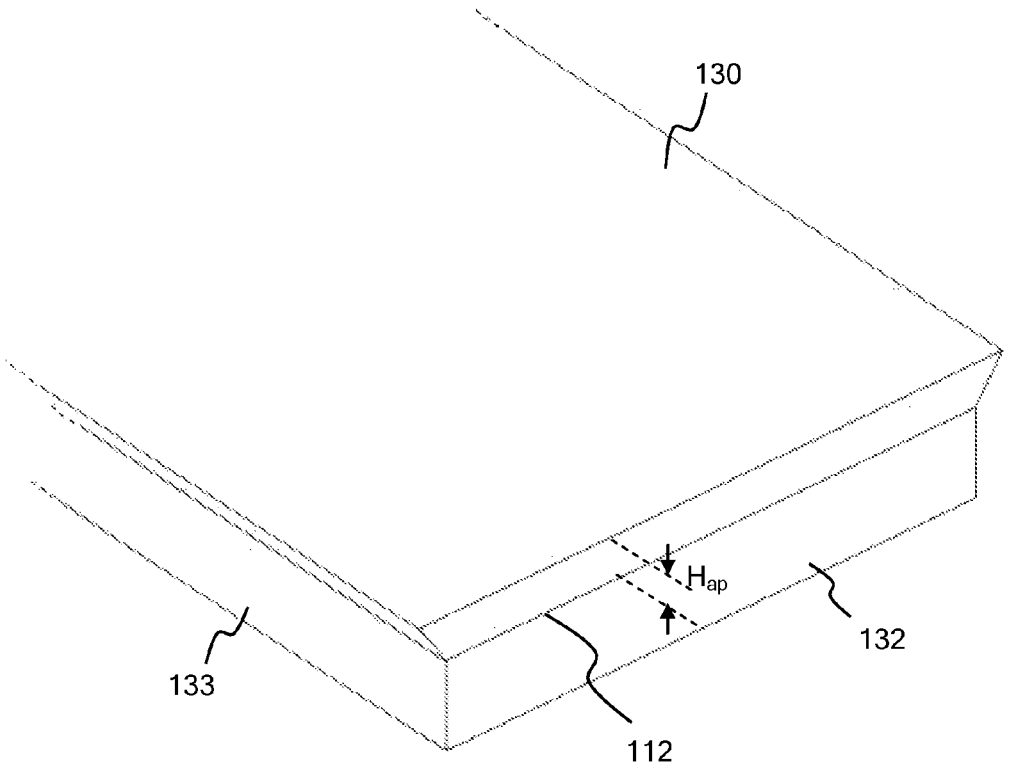
FIG. 28 shows a perspective view of level wet coating mixture 130 on surface 112 after tools 510 have been removed
Figure 29:
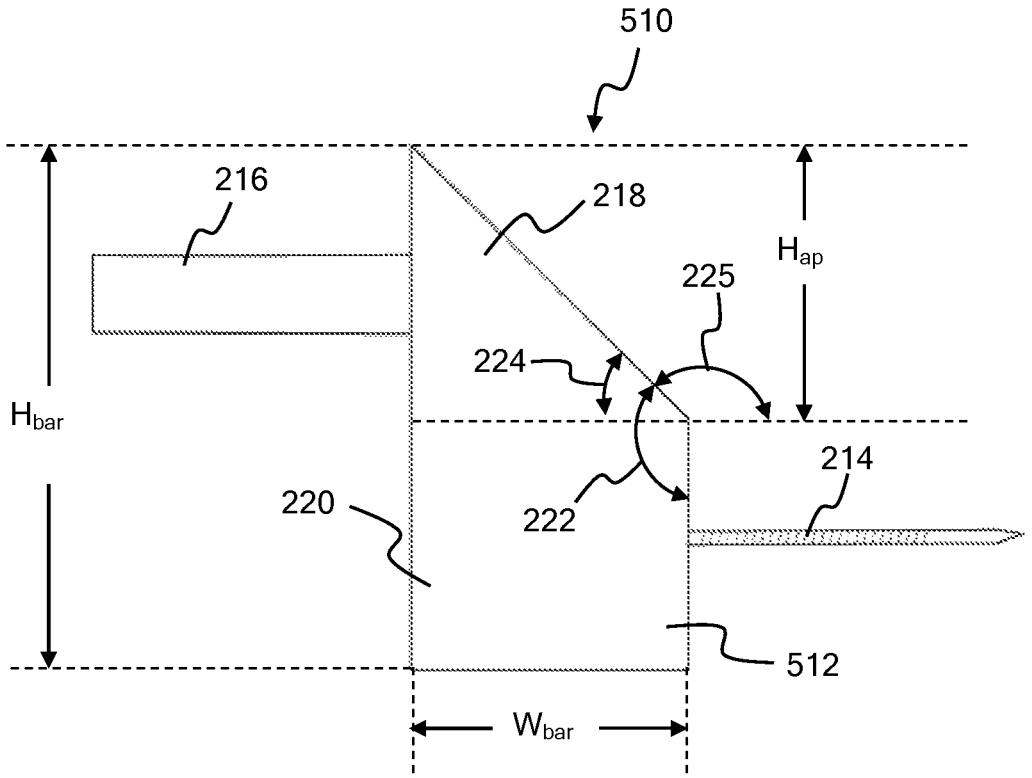
FIG. 29 shows a side view of tool 510 of FIG. 21.
Figure 30:
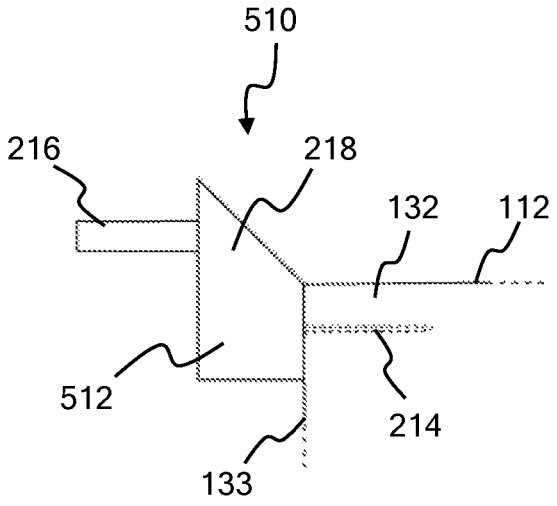
FIG. 30 shows a side view of tool 510 of FIG. 21 coupled to surface 133 of substrate 132 as shown in FIG. 26.
Figure 31:
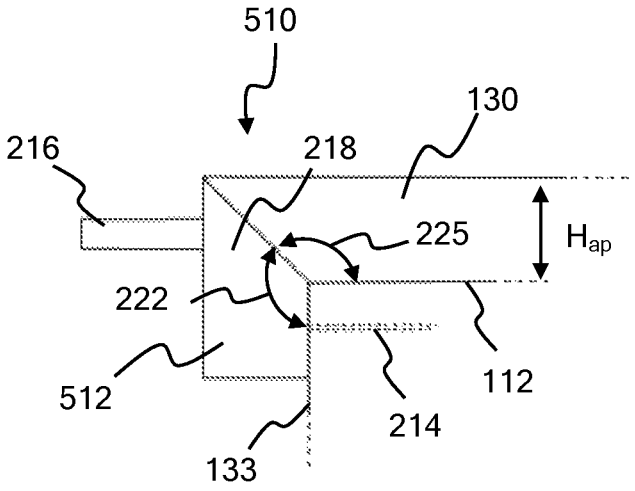
FIG. 31 shows a side view of tool 510 of FIG. 21 coupled to surface 133 of substrate 132, with wet coating mixture 130 applied to surface 112 and leveled off, as shown in FIG. 27.
Figure 32:
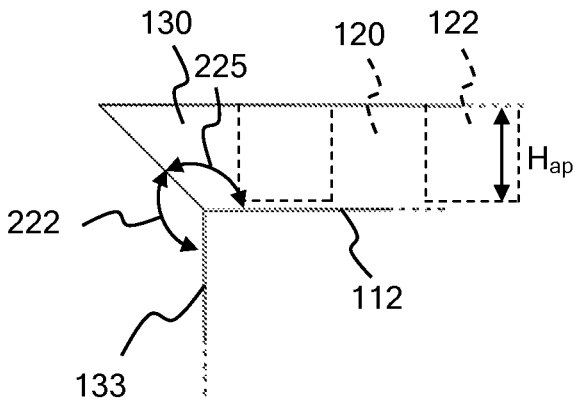
FIG. 32 shows a side view of wet coating mixture 130 on surface 112 after tool 510 is removed.
Figure 33:
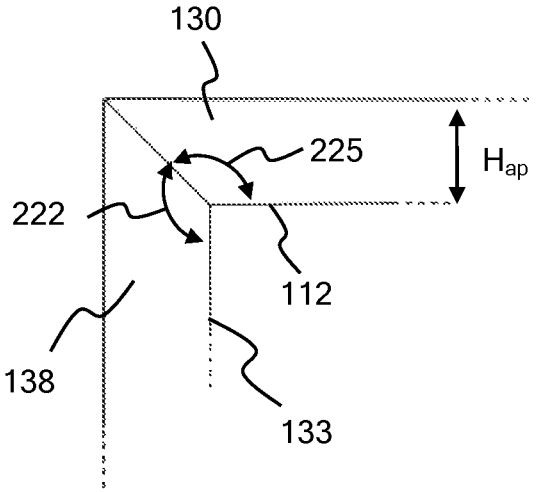
FIG. 33 shows a side view of a second wet coating mixture 138 applied to surface 133 of substrate 132, where coating mixture 130 has been allowed to dry and used as a screed level for second wet coating mixture 138.

FIG. 26 through FIG. 33 show tool 510 of FIG. 21 and how it is used. Tool 510 of the embodiment shown in FIG. 21 includes screed bar 512, where screed bar 512 has a trapezium-shaped cross-section, as shown in FIG. 21 and FIG. 29. Screed bar 512 has inner angle 222 as shown in FIG. 29. Inner angle 222 defines angle 225 that wet coating mixture 130 forms once wet coating mixture 130 is applied to surface 112 using tool 510, as shown in FIG. 31 through FIG. 33.

Screed bar 512 includes rectangular portion 220 and angle portion 218. Angle portion 218 has height $H_{ap}$ as shown in the figures. Height $H_{ap}$ defines the thickness of wet coating mixture 130 on surface 112 once wet coating mixture 130 is leveled off, as shown in FIG. 27, FIG. 28, and FIG. 31 through 33.

Figure 26:
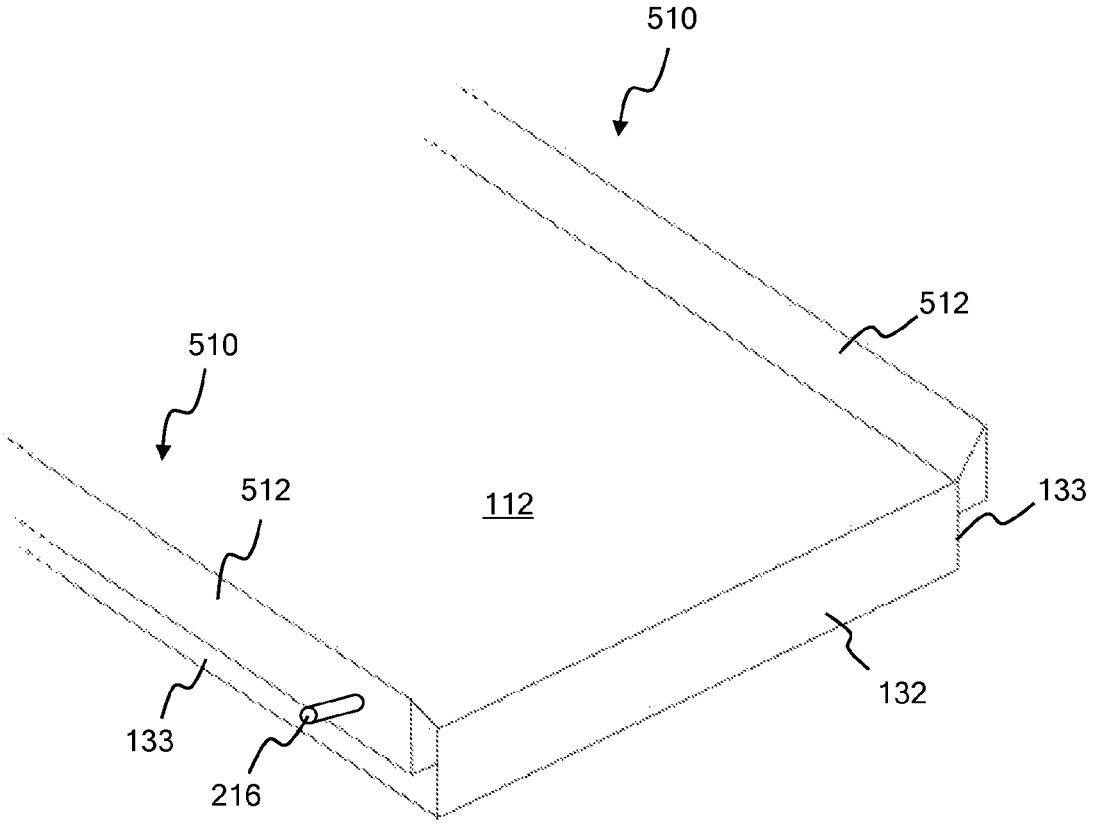
FIG. 26 shows a perspective view of tool 510 of FIG. 21 coupled to substrate 132.

Tool 510 according to the invention as shown in FIG. 21 is used by coupling screed bar 512 to side surfaces 133 as shown in FIG. 26 and FIG. 30. Screed bar coupling devices 214 are stuck into substrate 132 to temporarily couple screed bars 512 to substrate 132. Wet coating mixture 130 is then applied to surface 112, as shown in FIG. 27 and FIG. 31. A screed is set on screed bars 512 and moved across wet coating mixture 130 to level wet coating mixture 130, removing any excess wet coating mixture and leaving wet coating mixture 130 in a layer on surface 112 with a thickness of $H_{ap}$, as shown in the figures. Screed bar 212 inner angle 222 defines the coating angle 225 that the edge of coating 130 has to surface 112, as shown in FIG. 31. In this example, inner angle 222 is 135 degrees, and coating angle 225 is 135 degrees, but it is to be understood that this angle is an example only and that these angles will vary proportionally as screed bar 512 inner angle 222 is varied. Inner angle 222 is often in the range of 100 to 160 degrees, which creates an obtuse coating angle 225 for creating a secure and strong corner that can act as a screed to a layer on surface 112.

Screed bars 512 are removed from side surfaces 133, leaving wet coating mixture 130 on surface 112 of substrate 132, as shown in FIG. 28 and FIG. 32. Wet coating mixture 130 has a thickness of $H_{ap}$ and forms inner coating angle 225 with surface 112 as shown in FIG. 32. Wet coating mixture 130 can be left to dry as shown, or wet coating mixture can be further shaped, such as using trowel 110 as explained earlier to form crests 120 and valleys 122 in wet coating mixture 130, as shown in dotted lines in FIG. 32.

If desired, a second wet coating mixture 138 can be applied to surface 133, for example, as shown in FIG. 33. If wet coating mixture 130 is left to dry before applying second wet coating mixture 138, cured coating mixture 130 is used as a screed edge for second wet coating mixture 138, just as tool 510 acted as the screed edge for first wet coating mixture 130. Second wet coating mixture 138 will have an inner angle of 222 as shown in FIG. 33. Angle 222 and angle 225 can be chosen for maximum strength of the joint between coating mixtures 130 and 138. An embodiment as shown where both angles 222 and 225 are equal to 135 degrees creates a strong coating joint that resists cracking and separation at the juncture between the two coatings.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A trowel for shaping a wet coating mixture, the trowel comprising:

a trowel head, wherein the trowel head comprises:

a bottom surface, wherein the bottom surface is configured to contact the wet coating mixture;

and a plurality of channels in the bottom surface, wherein each channel is configured to shape the wet coating mixture in response to the trowel moving across a surface of the wet coating mixture;

wherein the channel extends a channel length from a trowel head rear surface to a trowel head front surface, wherein the channel length is greater than or equal to ¼ inch (6.35 mm);

wherein the channel further comprises:

a channel entrance opening in the trowel head rear surface, wherein the channel entrance opening has a channel entrance opening height;

and a channel exit opening in the trowel head front surface, wherein the channel exit opening has a channel exit opening height;

wherein the channel entrance opening height and the channel exit opening height are both equal to or greater than 3/16 inch (4.76 mm);

further comprising a removable front plate, wherein the removable front plate is adjustably coupled to the trowel head front surface; and wherein the front plate comprises a notch, wherein the notch is configured to shape the wet coating mixture in response to the trowel moving across the surface of the wet coating mixture.

2. The trowel of claim 1, wherein the channel entrance opening height is larger than the channel exit opening height.

3. The trowel of claim 2, wherein the channel further comprises:

a channel entrance opening width;

and a channel exit opening width;

wherein the channel entrance opening width and the channel exit opening width are both equal to or greater than 3/16 inch (4.76 mm).

4. The trowel of claim 3, wherein the channel entrance opening width is larger than the channel exit opening width.

5. The trowel of claim 4, wherein the plurality of channels are spaced apart from each other by a spacing, wherein the spacing is equal to or greater than ¾ inch (19.05 mm).

6. The trowel of claim 1, wherein the removable front plate is adjustable from a position away from the bottom surface to a position towards the bottom surface.

7. The trowel of claim 6, wherein the notch blocks a portion of the channel exit opening in response to the front plate being in the position towards the bottom surface.

8. A trowel for shaping a wet coating mixture, the trowel comprising:

a trowel head, wherein the trowel head comprises:

a bottom surface;

and a plurality of shaping elements coupled to the bottom surface, wherein each of the plurality of shaping elements is configured to shape the wet coating mixture as the trowel is moved across a surface of the wet coating mixture;

wherein each of the plurality of shaping elements is removably coupled to the bottom surface;

wherein each of the plurality of shaping elements has a shaping element thickness, wherein each shaping element thickness is equal to or greater than 3/16 inch (4.76 mm); and wherein each of the plurality of shaping elements is triangle shaped as seen in bottom view.

9. A trowel for shaping a wet coating mixture, the trowel comprising:

a trowel head, wherein the trowel head comprises:

a bottom surface;

and a plurality of shaping elements coupled to the bottom surface, wherein each of the plurality of shaping elements is configured to shape the wet coating mixture as the trowel is moved across a surface of the wet coating mixture;

wherein each of the plurality of shaping elements is removably coupled to the bottom surface;

wherein each of the plurality of shaping elements has a shaping element thickness, wherein each shaping element thickness is equal to or greater than 3/16 inch (4.76 mm); and wherein each of the plurality of shaping elements is rectangle shaped as seen in bottom view.

* * * * *